US009552973B2

(12) United States Patent
McEwen et al.

(10) Patent No.: US 9,552,973 B2
(45) Date of Patent: Jan. 24, 2017

(54) SYSTEM AND METHOD FOR IONIZATION OF MOLECULES FOR MASS SPECTROMETRY AND ION MOBILITY SPECTROMETRY

(75) Inventors: Charles Nehemiah McEwen, Newark, DE (US); Sarah Trimpin, Detroit, MI (US); Vincent Salvatore Pagnotti, Moosic, PA (US)

(73) Assignees: University of the Sciences in Philadelphia, Philadelphia, PA (US); Wayne State University, Detroit, MI (US)

( * ) Notice: Subject to any disclaimer, the term of this patent is extended or adjusted under 35 U.S.C. 154(b) by 315 days.

(21) Appl. No.: 13/819,487

(22) PCT Filed: Sep. 1, 2011

(86) PCT No.: PCT/US2011/050150

§ 371 (c)(1),
(2), (4) Date: May 8, 2013

(87) PCT Pub. No.: WO2012/031082

PCT Pub. Date: Mar. 8, 2012

(65) Prior Publication Data

US 2013/0214154 A1 Aug. 22, 2013

Related U.S. Application Data

(60) Provisional application No. 61/379,475, filed on Sep. 2, 2010, provisional application No. 61/391,248, filed (Continued)

(51) Int. Cl.

| | |
|---|---|
| ***H01J 49/00*** | (2006.01) |
| ***H01J 49/10*** | (2006.01) |
| ***H01J 49/04*** | (2006.01) |

(52) U.S. Cl.

CPC ..... *H01J 49/10* (2013.01); *H01J 49/0404* (2013.01); *H01J 49/0468* (2013.01)

(58) Field of Classification Search

None

See application file for complete search history.

(56) References Cited

U.S. PATENT DOCUMENTS 5,130,538 A * 7/1992 Fenn ..... B01D 59/44 250/282
5,382,793 A * 1/1995 Weinberger ..... H01J 49/025 250/281

(Continued)

FOREIGN PATENT DOCUMENTS

JP 06331616 A * 12/1994
JP H06331616 A 12/1994

(Continued)

OTHER PUBLICATIONS

International Preliminary Report on Patentability and Written Opinion issued Mar. 5, 2013 and Mar. 13, 2013, in counterpart International Application No. PCT/US2011/050150.

(Continued)

*Primary Examiner* — Andrew Smyth
(74) *Attorney, Agent, or Firm* — Duane Morris LLP

(57) ABSTRACT

An ionizing system includes a channel having an inlet disposed in a first pressure region and an outlet disposed in a second pressure region, a pressure of the first pressure region being greater than a pressure of the second pressure region. A heater is coupled to the channel and configured to heat the channel. A device is configured to introduce an analyte into the channel where the analyte is ionized.

24 Claims, 31 Drawing Sheets

Related U.S. Application Data on Oct. 8, 2010, provisional application No. 61/446,187, filed on Feb. 24, 2011, provisional application No. 61/493,400, filed on Jun. 3, 2011.

(56) References Cited

U.S. PATENT DOCUMENTS 5,581,080 A * 12/1996 Fenn ..... B01D 59/44 250/282
5,672,868 A * 9/1997 Mordehai ..... H01J 49/063 250/281
5,686,726 A * 11/1997 Fenn ..... B01D 59/44 250/281
5,818,041 A 10/1998 Mordehai et al.
6,118,120 A * 9/2000 Fenn ..... B01D 59/44 250/282
6,410,915 B1 * 6/2002 Bateman ..... H01J 49/107 250/281
7,034,292 B1 4/2006 Whitehouse et al.
7,075,640 B2 * 7/2006 Baer ..... G01N 1/2813 356/244
2004/0007673 A1 1/2004 Coon et al.
2004/0094702 A1 * 5/2004 Clemmer ..... G01N 27/622 250/283
2004/0159784 A1 * 8/2004 Doroshenko ..... H01J 49/403 250/288
2005/0056776 A1 3/2005 Willoughby et al.
2005/0173628 A1 * 8/2005 Ahern ..... H01J 49/105 250/288
2006/0269980 A1 * 11/2006 Gibbs ..... C12Q 1/34 435/23
2007/0048187 A1 * 3/2007 Sheehan ..... G01N 30/34 422/89
2007/0059776 A1 * 3/2007 Boschetti ..... C07K 1/16 435/7.2
2008/0111066 A1 * 5/2008 Zhang ..... G01N 33/6848 250/282
2008/0305555 A1 * 12/2008 Bouvier ..... H01J 49/04 436/173
2009/0159794 A1 6/2009 Schleifer et al.
2009/0194687 A1 * 8/2009 Jolliffe ..... H01J 49/10 250/288
2010/0090101 A1 * 4/2010 Schultz ..... H01J 49/0418 250/282
2010/0090104 A1 4/2010 Splendore et al.
2010/0276582 A1 * 11/2010 Chen ..... H01J 49/06 250/282
2011/0210242 A1 * 9/2011 Bateman ..... H01J 27/02 250/282

FOREIGN PATENT DOCUMENTS

JP 3379989 B2 * 2/2003
JP 2006518914 A 8/2006
WO 2006/081240 A1 8/2006

OTHER PUBLICATIONS

Supplementary European Search Report and Search Opinion issued in connection with corresponding European Patent application No. 11822641A, Nov. 17, 2016, 9 pages.

* cited by examiner

SYSTEM AND METHOD FOR IONIZATION OF MOLECULES FOR MASS SPECTROMETRY AND ION MOBILITY SPECTROMETRY

CROSS REFERENCE TO RELATED APPLICATIONS

This application is a national phase entry under 35 U.S.C. §371 of International Patent Application No. PCT/US2011/050150, which was filed Sep. 1, 2011 claiming priority to U.S. patent application Ser. No. 61/379,475, filed Sep. 2, 2010; to U.S. patent application Ser. No. 61/391,248, filed Oct. 8, 2010; to U.S. patent application Ser. No. 61/446,187, filed Feb. 24, 2011; and to U.S. patent application Ser. No. 61/493,400, filed Jun. 3, 2011, the entireties of which are hereby expressly incorporated by reference.

GOVERNMENT LICENSE RIGHTS

This invention was made with government support under National Science Foundation Career Award CHE-0955975 and NSF CHE-1112289. The government has certain rights in the invention.

FIELD OF DISCLOSURE

The disclosed systems and methods relate to spectrometry. More specifically, the disclosed systems and methods relate to ionizing molecules for mass spectrometry and ion mobility spectrometry.

BACKGROUND

Mass spectrometry is an analytical technique used to determine the elemental composition of a sample or molecule and is used in a wide variety of applications including trace gas analysis, pharmocokinetics, and protein characterization, to name a few. Mass spectrometry techniques typically include the ionizing of chemical compounds to generate charged molecules or molecule fragments in order to measure the mass-to-charge ratios. Ion mobility spectrometry measures the drift times of ions which is influenced by the size (shape) and charge of the ions.

Various methods have been developed to ionize samples or molecules. For example, electrospray ionization ("ESI") produces charged droplets of the solvent/analyte from a liquid stream passing through a capillary onto which a high electric field is applied relative to a counter electrode. The charged droplets are desolvated (evaporation of the solvent, but not the charge) until the Raleigh limit is reached in which the charge repulsion of like charges exceeds the surface tension of the liquid. Under these conditions so called "Taylor cones" are formed in which smaller droplets are expelled from the parent droplet and carry a higher ratio of charge to mass than the parent droplet. These prodigy droplets can undergo this same process until eventually ions are expelled from the droplet due the high-repulsive field (ion evaporation mechanism) or the analyte ions remain after all the solvent evaporates.

Another ionization process called sonic spray ionization ("SSI") has also been developed. In SSI, a high velocity of a nebulizing gas is used to produce charged droplets instead of an electric field as used in ESI.

However, these conventional methods of ionizing a solution with an analyte require an electric field or a high velocity gas, which increase the complexity and cost of the spectrometry system. The above methods also involve producing ions at or near atmospheric pressure and transferring them through a channel to a lower pressure for mass analysis, which is an inefficient process.

An ionization method is matrix assisted laser desorption/ionization ("MALDI"). In MALDI, a laser ablates analyte that is incorporated into a matrix (small molecule that absorbs radiation from the laser) which produces mostly singly charged ions that are mass analyzed. More recently, an ionization method called laserspray ionization ("LSI") was discovered that produces ions of very similar charge states as ESI, but by laser ablation of a solid matrix/analyte mixture. This method is similar to MALDI in that laser ablation of a matrix initiates the process, but is similar to ESI in that multiply charged ions are observed.

SUMMARY

An ionizing system includes a channel having an inlet disposed in a first pressure region and an outlet disposed in a second pressure region, a pressure of the first pressure region being greater than a pressure of the second pressure region. A heater is coupled to the channel and configured to heat the channel. A device is configured to introduce an analyte into the channel where the analyte is ionized.

An ionizing method includes creating a pressure differential across a channel having a first end disposed in a first pressure and a second disposed in a second pressure, heating the channel, receiving an analyte in the channel, and ionizing the analyte in the channel. The first pressure is greater than the second pressure;

BRIEF DESCRIPTION OF THE DRAWINGS

These and other features and advantages of the present systems and methods will be more fully disclosed in, or rendered obvious by the following detailed description of the preferred embodiments, which are to be considered together with the accompanying drawings wherein like numbers refer to like parts and further wherein.

DETAILED DESCRIPTION

Figure 1:
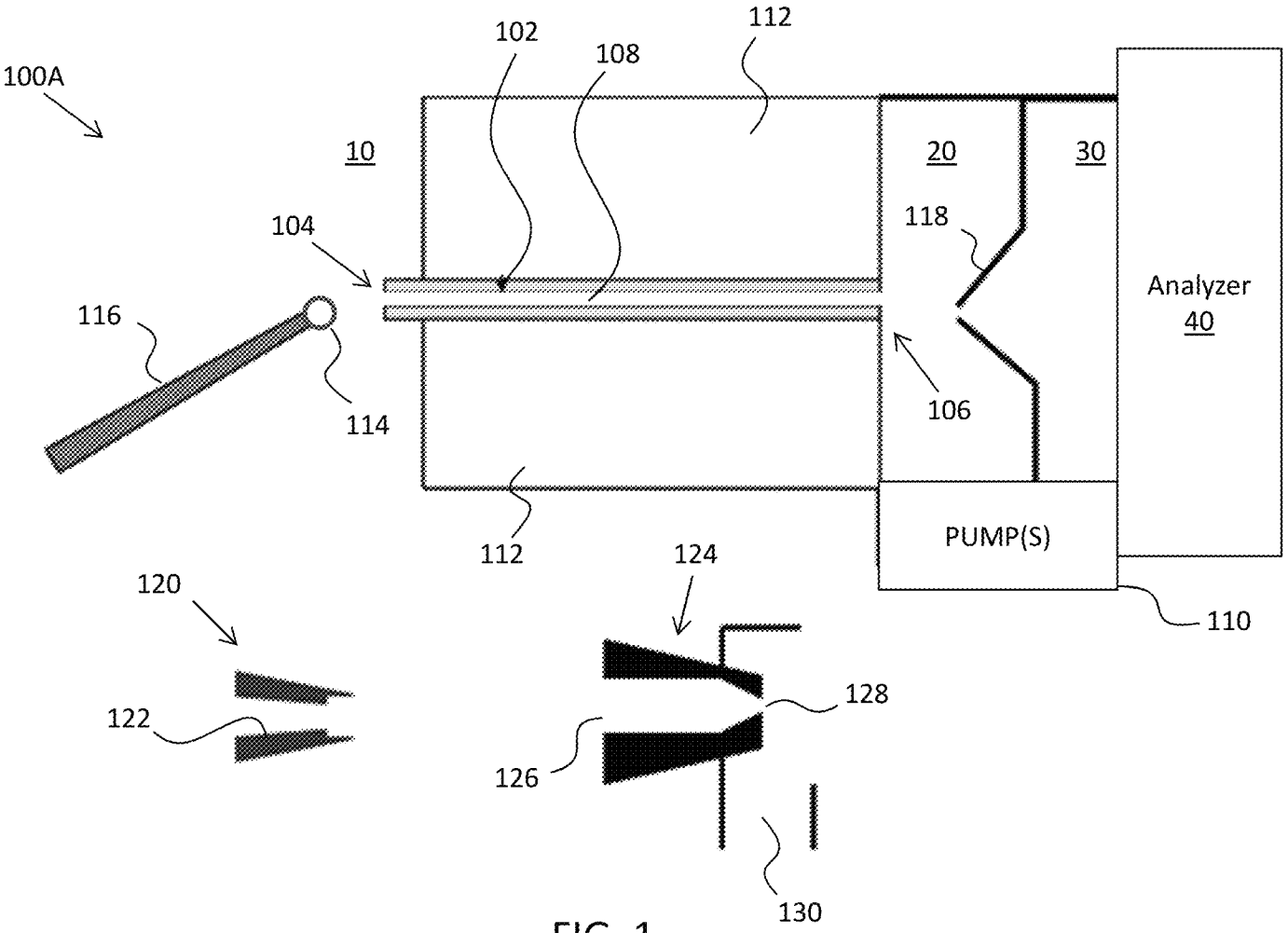
FIG. 1 is a diagram of one example of an improved ionizing system.

This description of preferred embodiments is intended to be read in connection with the accompanying drawings, which are to be considered part of the entire written description. The drawing figures are not necessarily to scale and certain features of the invention may be shown exaggerated in scale or in somewhat schematic form in the interest of clarity and conciseness. In the description, relative terms such as "horizontal," "vertical," "up," "down," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral," and the like are to be interpreted relative to one another or relative to an axis of elongation, or an axis or center of rotation, as appropriate. Terms concerning attachments, coupling, and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Unless otherwise stated, all percentages, parts, ratios, or the like are by weight. When an amount, concentration, or other value or parameter is given as either a range, preferred range, or a list of upper preferable values and lower preferable values, this is understood as specifically disclosing all ranges formed from any pair of any upper range limit or preferred value and any lower range limit or preferred value regardless of whether those ranges are explicitly disclosed.

FIG. 1 illustrates one example of an improved system 100A for matrix assisted inlet ionization for ionizing (generating positively and negatively charged ions) a matrix/analyte sample or analyte sample. The matrix may be a liquid or solid compound and the analyte may be a pure compound or a complex mixture of compounds. As shown in FIG. 1, the system 100A includes a transfer capillary 102 having an inlet 104 and an outlet 106 that communicatively couple a first pressure region 10 with a second pressure region 20 through opening 108. Transfer tube 102 may be a transfer tube of a commercially available liquid chromatography/mass spectrometry ("LC/MS"), mass spectrometer, or ion mobility spectrometer instrument and/or fabricated from various materials including, but not limited to, metals, ceramics, glass, and other conductive and non-conductive materials. Such instruments include mass spectrometers having high-mass resolving power and high-accuracy mass measurement such as Fourier Transform Ion Cyclotron mass spectrometers ("FTMS"), Orbitrap, time-of-flight ("TOF"), and quadrupole TOF ("Q-TOF") mass analyzers. Some of these instruments are available with ion mobility separation and electron transfer dissociation, which benefit from multiple charging that improves the ability to characterize the sample.

In one embodiment, the first pressure region 10 has a higher pressure than the second pressure region 20, which may be an intermediate pressure region pumped by a rotary pump 110 and is disposed adjacent to a vacuum region 30 of an analyzer 40. Examples of analyzer 40 include, but are not limited to, quadrupole, orbitrap, time-of-flight, ion trap, and magnetic sector mass analyzers, and a ion mobility analyzer, to list a few possibilities. As will be understood by one skilled in the art, vacuum region 30 may also be pumped by one or more pump(s) 110. The gas in the first, second, and vacuum regions 10, 20, and 30 may be air, although other gases may be used to increase the sensitivity of the system. Examples of such gases include, but are not limited to, nitrogen, argon, and helium, to name a few possibilities. The gas in region 10 may be at or near atmospheric pressure with higher ion abundance correlating to a larger pressure differential between regions 10 and 20. A heating device 112 is coupled to the outer surface of the transfer capillary 102 for heating the capillary or transfer tube 102. The heating device 112 may be a resistive or electric, radiative, convective, or through other means of heating the transfer tube 102.

A matrix/analyte sample 114, which is illustrated as being disposed on a substrate 116, may be applied to the inlet 104 of transfer tube 102 or directly into capillary opening or channel 108. In some embodiments, the matrix and analyte include a sample produced by combining both in a solvent system and removing the solvent to achieve a dry matrix/analyte sample for analysis. The matrix may be in a higher concentration than that of the analyte. For example, the ratios of matrix to analyte may be between approximately 50:1 and 1,000,000,000,000:1, although one skilled in the art will understand that other matrix to analyte ratios are possible. Additionally, one skilled in the art will understand that other means in which the analyte and matrix are combined may also be implemented. For example, the matrix and analyte may be ground together using a mortar and pestle or by using vibrating beads.

In some embodiments, the matrix may be omitted such that sample 114 only includes an analyte, which is disposed on substrate 116. The matrix can be a liquid solvent such as water or a solid such as 2,5-dihydroxybenzoic acid ("2,5-DHB"). A skimmer 118 may be disposed adjacent to the exit 106 of the transfer tube 102 and between intermediate pressure region 20 and the vacuum region 30. In one embodiment, the opening of skimmer 118 is disposed such that an axis defined by transfer tube 102 does not intersect the opening of skimmer 118, i.e., the opening of skimmer 118 is "off-axis" with the exit end 106 of transfer tube 102. In some embodiments, ion, quadrupole, hexapole, or other lens element(s) may be used to guide ions from exit 106 of transfer tube 102 to the vacuum region 30 of analyzer 40. In some embodiments, skimmer 118 or lens elements may be at an angle between 70 degrees and 110 degrees, and more particularly at 90 degrees, with respect to a longitudinal axis defined by transfer tube 102.

In some embodiments, a device 102 having a conical or tapered interior region 122 is removably coupled to the inlet 104 of transfer tube 102 to present a larger entrance for matrix/analyte particles and to reduce contamination of the transfer tube 102. Device 120 may be removable so that it may be replaced or cleaned without removal of the transfer tube 102. In this way, the sensitivity is increased and the system is useful for longer periods of time before the transfer capillary 102 must be removed and cleaned. Device 120 may include an insulating material, such as ceramic or glass, and contain electrodes to remove charged matrix particles or droplets before they enter transfer tub 102 when using laser ablation of a matrix/analyte mixture. Interior region 122 of device 120 may be disposed at an angle with respect to an axis defined by channel 108 of transfer tube 102. Using device 120, transfer tube 102 remains clean for longer periods without reduction in sensitivity of the ionizing system.

In other embodiments, a jet separator device 124 having a wider initial opening 126 and a cone shaped or otherwise tapered exit 128 for directing particles toward the capillary opening 108 of transfer tube 102 is aligned with, but spaced apart from, inlet 104 of transfer tube 102. For example, device 124 may be spaced apart from inlet 104 by approximately 1 mm, although one skilled in the art will understand that device 124 may be spaced closer to, or farther away from, inlet 104. The region 130 between the exit of device 124 and the inlet 104 of transfer tube 102 may be pumped by a rotary pump 110.

Figure 2:
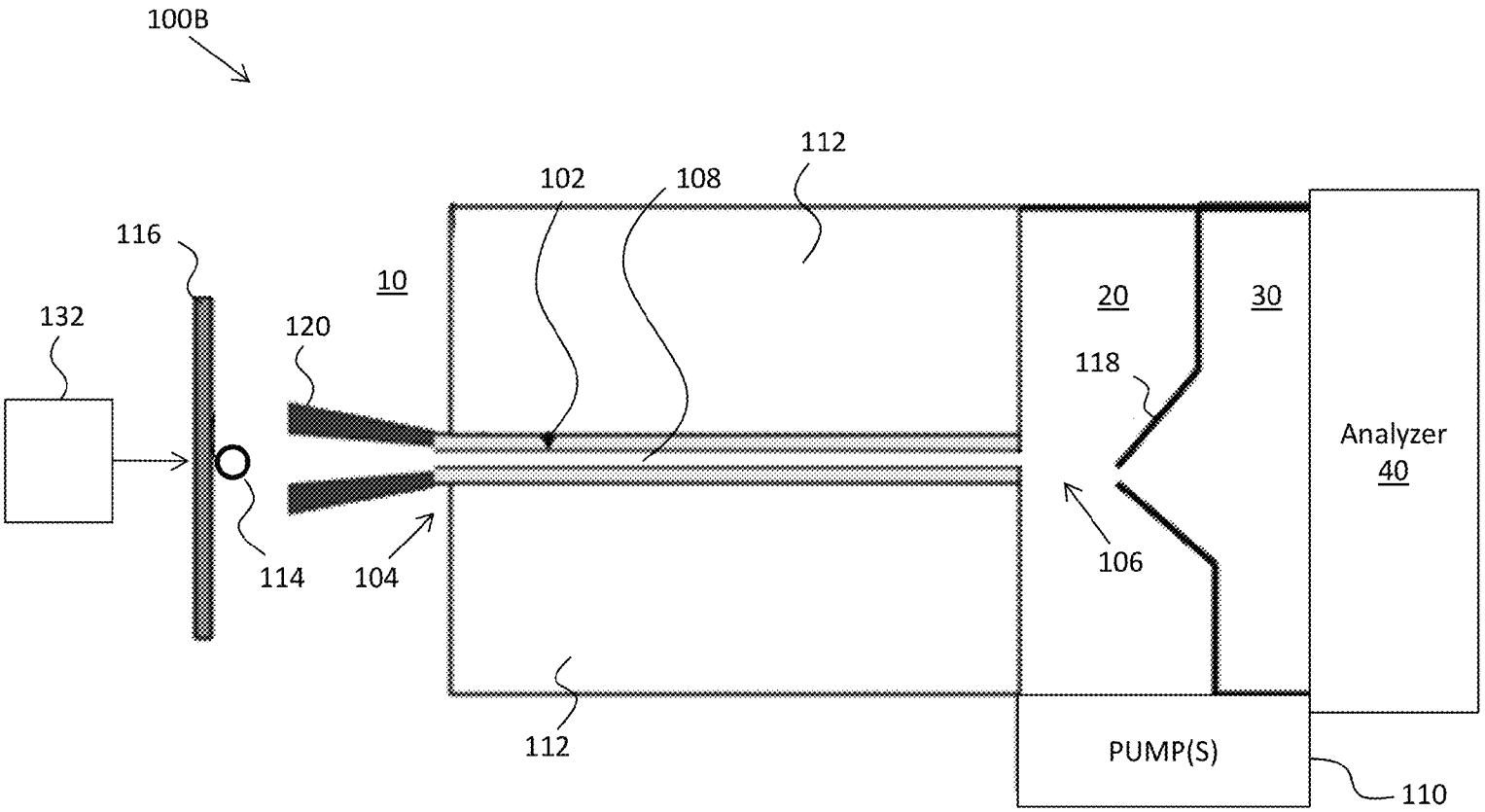
FIG. 2 is a diagram illustrating another example of an improved ionizing system.

A variety of impact methods may also be utilized to produce matrix/analyte or analyte particles that can be transferred to the transfer tube 102 for ionization (generating positively and negatively charged ions). FIG. 2 illustrates one example of a system 100B for ionizing a matrix/analyte sample or analyte 114 that utilizes an impact to introduce the matrix/analyte sample or analyte 114 into a heated capillary or transfer tube 102. As shown in FIG. 2, transfer tube 102 is surrounded by heaters 112 for ionization which occurs in the capillary channel or conduit 108. Removable cone device 120 may be disposed at the entrance 104 to the transfer tube 102. The matrix/analyte sample or analyte sample 114 is disposed on a plate or substrate 116, which is contacted by an object 132. The acoustic or shock wave from the impact of the object 132 on the substrate 116 dislodges a portion of sample 114 and propels it into the cone device 120 or towards inlet 104, which by gas dynamics (i.e., the pressure differential between the inlet 104 and outlet 106 of transfer tube 102) directs the matrix/analyte or analyte particles into the transfer tube 102 where ionization occurs.

In some embodiments, a laser (not shown) can be used to produce acoustic or shock waves that dislodge matrix/analyte 114 into fine particles as in the technique called laser induced acoustic desorption ("LIAD"). Lasers, such as, for example, ultraviolet lasers, may also be used to ablate the matrix/analyte or analyte sample 114 directly and introduce the ablated material into the transfer tube 102 as is utilized in laserspray ionization ("LSI") as will be understood by one skilled in the art. Because the laser is used to ablate the matrix/analyte sample 114, other wavelength lasers may be used including, but not limited to, visible and infrared lasers. The use of lasers allows a focused area of the matrix/analyte or analyte 114 to be ablated and is thus useful for high sensitivity and imaging studies, and in particular tissue imaging.

Figure 3:
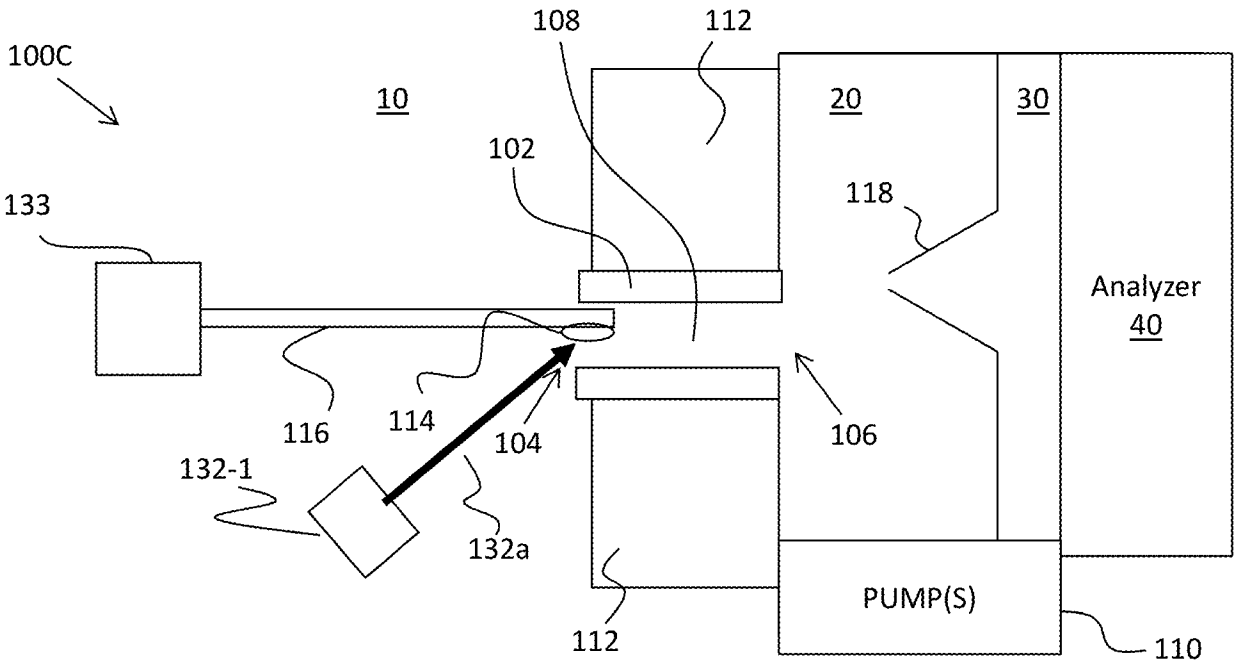
FIG. 3 illustrates another example of an improved ionizing system.

In the embodiment of the system 100C illustrated in FIG. 3, sample 114 is disposed on substrate 116 located near or within inlet 104 of channel 108. Inlet 104 may have a larger width or diameter than a width or diameter of inlet 104 illustrated in FIGS. 1-2 such that substrate 116 may be received within transfer tube 102. Sample 114 may be dislodged from substrate 116 using a laser beam 132*a* emitted from device 132, which may be a laser source as will be understood by one skilled in the art. In some embodiments, a device 133, such as a piezoelectric device, is in fluid contact with substrate 116 and is used to dislodge sample 114 from substrate 116. The use of devices 132 or 133 in the arrangement illustrated in FIG. 3 reduces sample loss via diffusion before the inlet 104 of tube 102, which enables smaller sample sizes to be analyzed with improved sensitivity.

Figure 4:
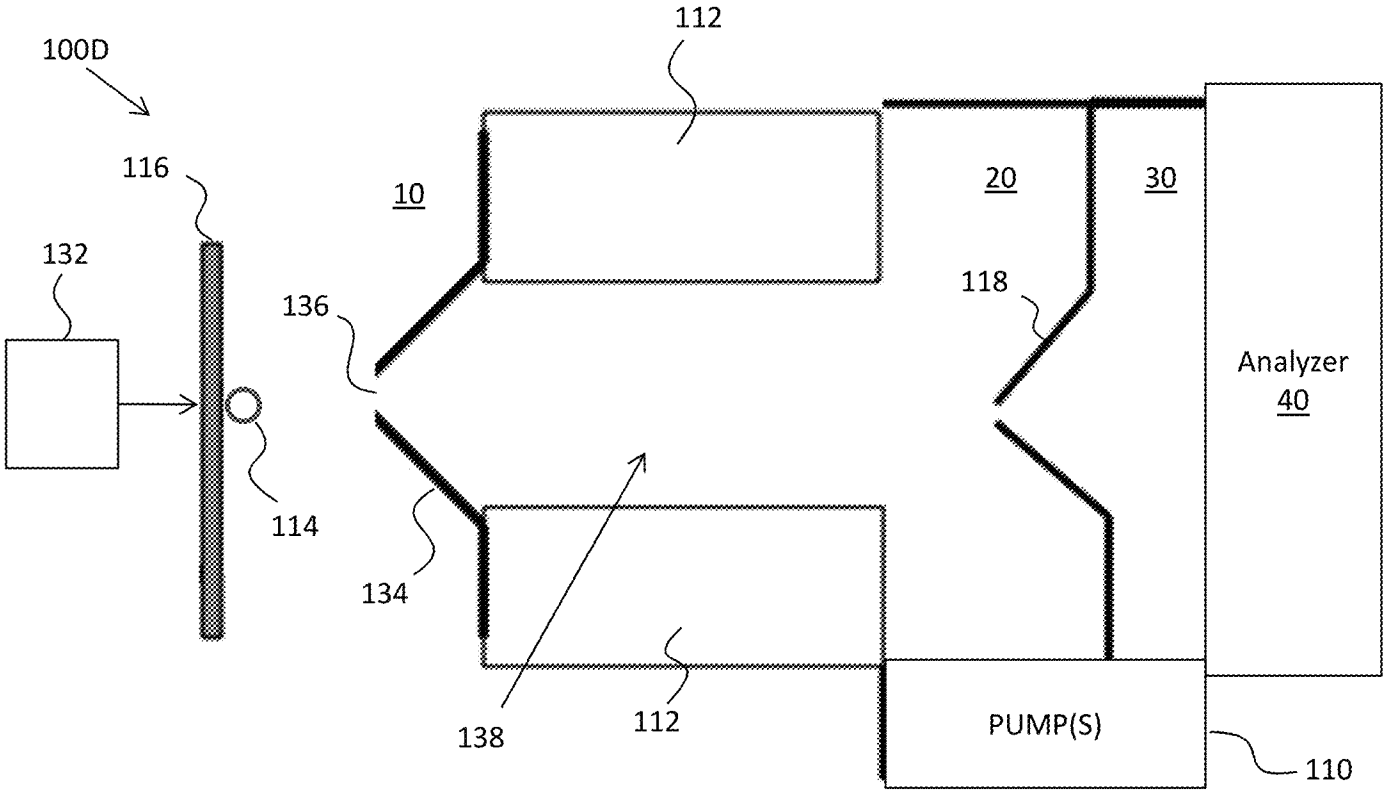
FIG. 4 illustrates another example of an improved ionizing system.

In some embodiments, such as the embodiment of system 100D illustrated in FIG. 4, transfer tube 102 may be eliminated and a skimmer 134 having an aperture 136 may be positioned in first pressure region 10 and coupled to heaters 112 such that skimmer 134 may be heated by heaters 134. Thus, in some embodiments, one or more heaters 112 define a capillary or conduit 138 between a first pressure region 10 and an intermediate pressure region 20. The impact device 132 may be a laser or other object for providing a force to produce an acoustic or shock wave to urge sample 114 from plate or substrate 116, through a space 138 defined by heaters 112, and ultimately toward vacuum region 30 in the form of ions or ionized matrix/analyte droplets or particles.

Figure 5:
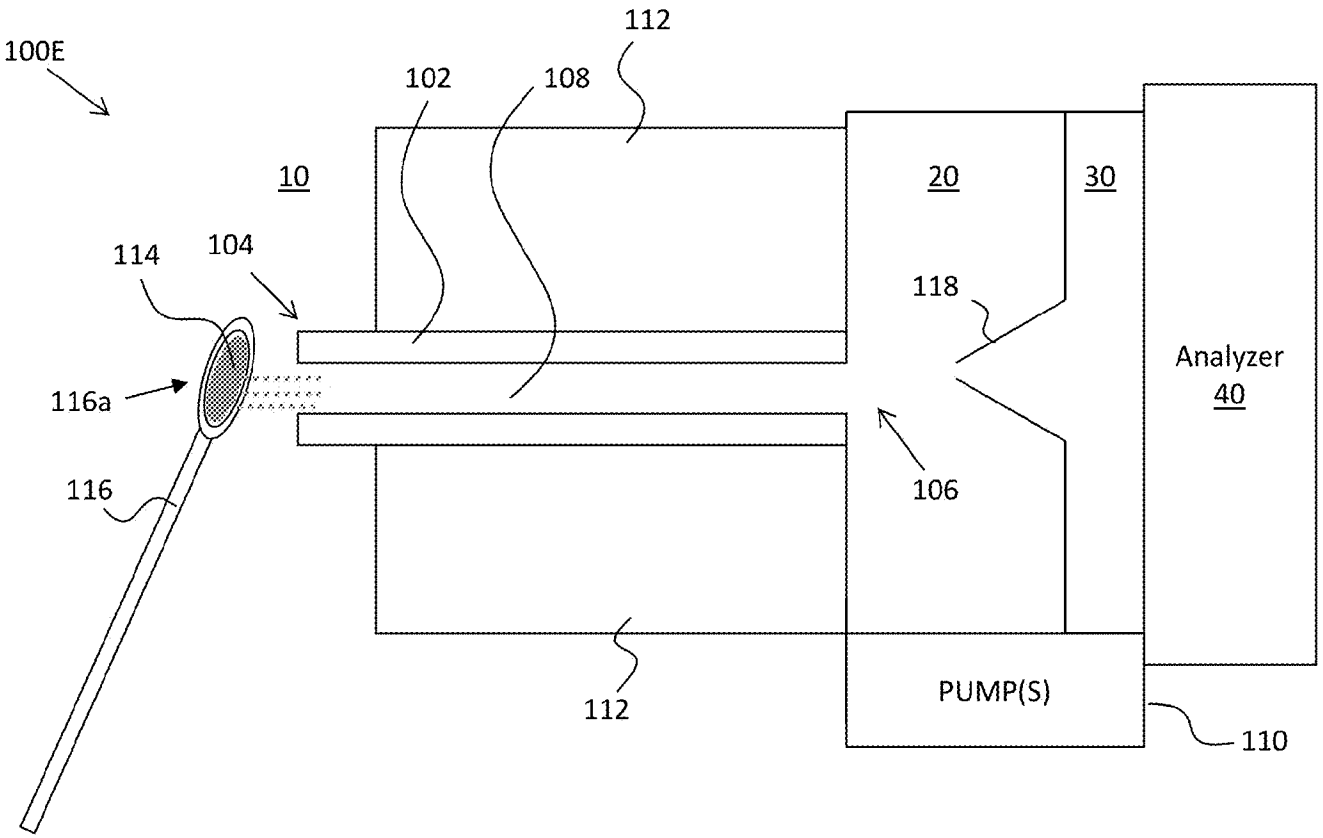
FIG. 5 illustrates another example of an improved ionizing system.

FIG. 5 illustrates an embodiment of a system 100E for solvent assisted inlet ionization ("SAII"). As shown in FIG. 5, an analyte/solvent 114 may be applied to inlet 104 of transfer capillary 102 in discreet increments by applying the analyte/solvent 114 to a substrate 116 and holding an area 116*a* of the substrate 116 on which the analyte/solvent 114 is disposed close to inlet 104. The pressure differential across transfer capillary 102 is sufficient to cause the analyte/solvent 114 to enter transfer capillary 102 in the dynamic flow of gas from the higher pressure region 10 to the lower pressure region 20. In the embodiment illustrated in FIG. 5, substrate 116 is in the form of a needle and analyte/solvent 114 is disposed within the eye 116*a* of needle 116. Other means of holding liquid solution, such as a syringe, can be used to introduce the sample to inlet 103 of transfer tube 102. Solutions containing an analyte, as in liquid chromatography ("LC") mobile phase, may be introduced using fused silica or other capillary tube as substrate 116. One skilled in the art will understand that substrate 116 may have other shapes and be fabricated from a wide array of materials including, but not limited to, glass, metal, and polymer, to name of a few possible materials. In some embodiments, transfer capillary 102 may be heated between approximately 100° C. and 500° C. with the analyte/sample 114 being introduced in increments of approximately 50 nL or more.

Analyte/solvent may include, but is not limited to, water, water/organic solvent mixtures, and pure organic solvents. Additives may be added to the analyte/solvent 114. Examples of such additives include, but are not limited to, weak acids (such as acetic or formic), bases (such as ammonium hydroxide), salts (such as ammonium acetate), and/or modifiers (such as glycerol or nitrobenzyl alcohol), to name a few possible additives. The amount of an additive in the analyte may be varied as will be understood by one skilled in the art. In some embodiments, an amount of an additive may be between 0 and 50 percent weight. In some embodiments, an additive may be between 0 and 5 percent weight such as approximately 0.1 percent weight.

Figure 6:
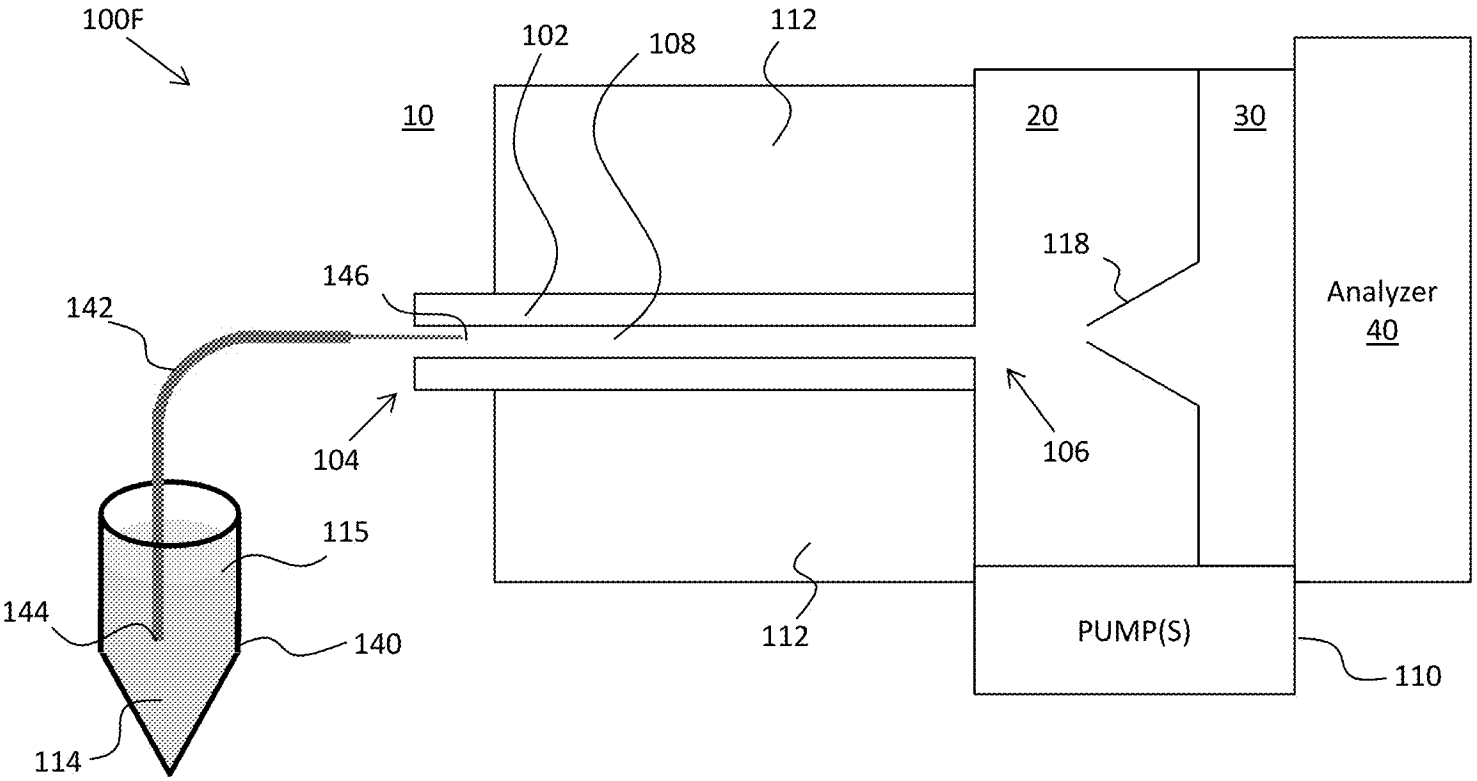
FIG. 6 illustrates another example of an improved ionization system.

FIG. 6 illustrates another embodiment of a system 100F for introducing an analyte 114 into a transfer capillary 102 through a channel such as a fused silica capillary. In the embodiment illustrated in FIG. 6, analyte/solvent 114 is continuously introduced into inlet 104 of transfer capillary 102 using a liquid chromatograph or other liquid introduction method including capillary electrophoresis, microdialysis, a liquid junction, and microfluidics or from a container 140 in which the pressure differential between the surface 115 of the analyte/solvent 114 and the exit 146 of tubing 142 causes the analyte/solvent 114 to flow into transfer tube 102 as will be understood by those skilled in the art. As shown in FIG. 6, analyte/solvent 114 is disposed within a container 140 having a column or capillary 142 extending therefrom. For example, capillary 142 may have a first end 144 disposed within analyte/solvent 114 in container 140 and a second end 146 disposed adjacent to or within inlet 104 of transfer capillary 102. Capillary 142 may be fabricated from metal, silica, or any material that is substantially resistant to temperatures of up to approximately 450° C. The analyte/solvent 114 travels through column 142 where it is introduced into transfer capillary 102.

In some embodiments, an outer diameter of column 142 is smaller than an inner diameter of inlet 104 such that column 142 may be received within transfer capillary 102 without completely restricting the flow of gas between high pressure region 10 and low pressure region 30. The depth at which column 142 is inserted into inlet 104 of transfer capillary 102 may be varied to achieve the desired results as in a tuning procedure as will be understood by those skilled in the art. For example, column 142 may be received within transfer capillary 102 by less than a few millimeters up to and beyond several centimeters. In some embodiments, column 142 contacts transfer capillary 102, although one skilled in the art will understand that column 142 may be disposed adjacent to, i.e., outside of, transfer capillary 102 in a non-contact or non-abutting relationship. In some embodiments, transfer capillary 102 may be heated between approximately 100° C. and 500° C. by heaters 112 with the analyte/sample 114 being introduced at a flow rate of approximately 100 nL or more.

Introducing analyte 114 into a transfer capillary 102 using SAII in accordance with one of the embodiments illustrated in FIGS. 5 and 6 advantageously reduces the amount of ion losses from field effects at the rim of the capillary opening 104 as well as reduces losses attributed to the dispersion of the analyte 114 being introduced into capillary 102 as occurs in ESI and SSI. The SAII technique is sensitive, allowing sub-picomolar solutions of peptides such as bradykinin to be detected, because ion losses are minimized. Additionally, the SAII technique of introducing an analyte into a transfer capillary does not require an expensive ion source, a high voltage, or lasers. Such a configuration is advantageous for field portable ion mobility and mass spectrometer instruments.

Figure 7:
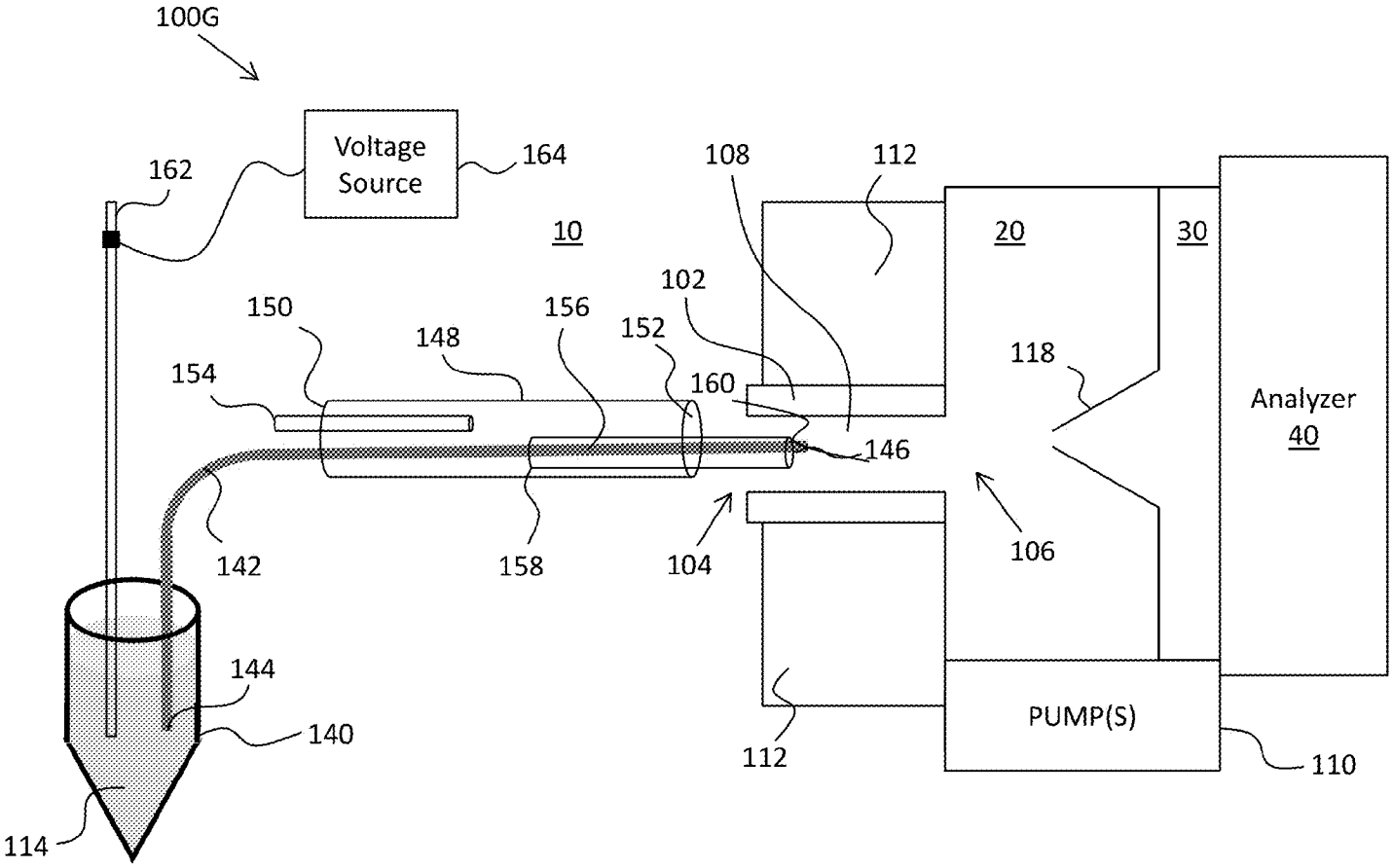
FIG. 7 illustrates another example of an improved ionization system.

FIG. 7 illustrates an embodiment of a system 100G in which a voltage is applied to analyte/solvent 114 to increase the number of ions produced. Although an electrode 162 and voltage source 164 are illustrated, these components may be omitted as described below. As shown in FIG. 7, analyte/solvent 114 is disposed in a container 140, which may be a liquid chromatograph as will be understood by one skilled in the art. A column or capillary 142 has a first end 144 disposed within the analyte/solvent 114 within container 140 and a second end 146 disposed within channel 108 of transfer tube 102. Mixing tube 148 has a pair of opposed sealed ends 150, 152. End 150 of mixing tube 148 receives capillary 142 and a nebulizing tube 154 therein.

Nebulizing tube 154 may be configured to inject a nebulized gas from a nebulizing source (not shown) into mixing tube 148. End 152 of mixing tube 148 receives an transfer tube 156 therethrough. Transfer tube 156 has a first end 158 disposed within mixing tube 148 such that end 158 is disposed adjacent to end 146 of capillary 142 and the nebulizing gas from tube 154 enters end 158. Transfer tube 156 may fit over or be concentric with capillary 142. The second end 160 of transfer tube 156 may be disposed within or a few millimeters from end 146 of transfer capillary 102 as shown in FIG. 7. One skilled in the art will understand that other means of nebulizing solvent streams are available.

An electrode 162 is disposed within analyte/solvent 114 and is coupled to a voltage source 164. Voltage source 164 may be configured to provide a voltage to analyte/solvent 114 between approximately 500 volts and 5,000 volts. In some embodiments, voltage source 164 may be configured to provide a voltage between approximately 700 volts and 3,000 volts. One skilled in the art will understand that voltage source 164 may be able to provide other voltages to analyte/solvent 114.

Electrically enhancing the ionization of liquid droplets within the inlet 104 of transfer tube 102 as shown in FIG. 7 reduces and/or eliminates dispersion and so call 'rim' losses associated with the ESI in which the electrospray occurs before the entrance to the inlet transfer tube 106. The combination of field-enhanced ionization SAII in this configuration provides efficient ionization.

Nebulizing gas in the absence of a voltage can be used to direct solvent droplets into the inlet capillary for SAII, and with a high flow of nebulizing gas, ionization occurs through a low solvent flow sonic spray mechanism in combination with SAII. The solvent can be introduced into transfer tube 102 along with a nebulizing gas as shown in FIG. 7. Methods of forming ions within the transfer capillary 102 are advantageous as they eliminate losses associated with the entrance orifice and dispersion losses outside the entrance orifice of transfer tube 102. Ionization within the transfer capillary 102 occurs under sub-atmospheric pressure conditions thereby enhancing ion transfer efficiency into the analyzer 40. Under these conditions, so-called "ion funnels," as will be understood by one skilled in the art, may be used as an efficient means of transferring ions from exit 106 to analyzer 40.

SAII may be used with LC with flow rates greater than about 100 nanoliters per minute ("nanoflow") up to approximately one milliliter per minute. Low solvent flow SAII, as in nanoflow, is possible and does not require a voltage or special exit tips as required in nanoflow ESI; however, a voltage and specialized exit tips may be used to enhance ionization or produce a stable ion current.

Nanoflow SAII may be used with or without a nebulizing gas 154 as illustrated in FIG. 7. A nebulizing gas may to aid transfer of the liquid flowing from the exit 146 of capillary tube 142 into the heated MS inlet 104. The use of concentric tubes 142 and 156 (FIG. 7) in which the inner tube 142 carries the liquid solution or LC mobile phase and the outer tube 156 a flow of gas, usually nitrogen or air, for liquid nebulization allows a wider range of mobile phase flow rates and reduces problems associated with mobile phase evaporating within the capillary tube 146. Evaporation of the mobile phase is reduced because of the cooling effect of the nebulizing gas on the inner tube 142 thereby allowing the capillary tube exit 146 to be placed either outside with the nebulized mobile phase droplets directed at the inlet 104 or inside the heated MS inlet orifice 104. Because ionization of volatile compounds in the room air will occur when liquid is being ionized within the inlet 108, there are low-mass contaminant ions from compounds in the air that can be reduced or eliminated by the use of a clean nebulizing or curtain gas 154 which reduces room air entering the inlet.

Increasing the back pressure, which increases the flow of nebulizing gas 154 that passes through transfer tube 156 and nebulization of mobile phase 114 at end 146 of capillary tube 142, produces ions by a sonic spray ionization ("SSI") with solvent flow rates of approximately 100 nanoliters per minute ("nanoSSI") and above. Thus, flow solvent flow rates of 100 nanoliters per minute to 10 microliters per minute produce ions by nanoSSI. End 146 of capillary 142 during nanoSSI may be on the atmospheric pressure side of inlet 104 or inserted through inlet 104 into channel 108. In either case, ionization of droplets entering the heated transfer tube 102 will be ionized by SAII. NanoSSI is an alternative method for high sensitivity nano- and micro-flow liquid chromatography and advantageously does not require the use of a voltage.

Because in LC, samples containing high levels of non-volatile hydrophilic compounds such as salts are frequently analyzed, it has been a common practice to divert the mobile phase during the early part of a reverse phase chromatography separation (void volume) so that these materials dissolved in the mobile phase do not enter and contaminate the ion source. However, diverting mobile phase is difficult in nanoflow ESI LC because increased dead volume caused by the diverter valve results in peak broadening. The SAII method, especially nanoSAII, is sufficiently robust that diversion of the early elution volume containing salts is as simple as moving the exit end of the LC capillary tube away from the entrance using an x,y or x,y,z stage during the time the void volume is eluting. At a user selected time, the exit end of the capillary can be placed back where ionization occurs using the x,y- or x,y,z-stage.

Another method to divert the flow from the LC away from the inlet 104 during elution of salts in the void volume that is applicable to nanoSAII is to use a solenoid to push the fused silica capillary tubing 146 away from inlet 104. Under these conditions, exit end 146 of capillary 142 is positioned outside of inlet 104. Using these methods, nanoSAII results in minimal contamination of the inlet and vacuum optics of the mass analyzer and can be run for extended periods without loss of sensitivity.

Figure 8:
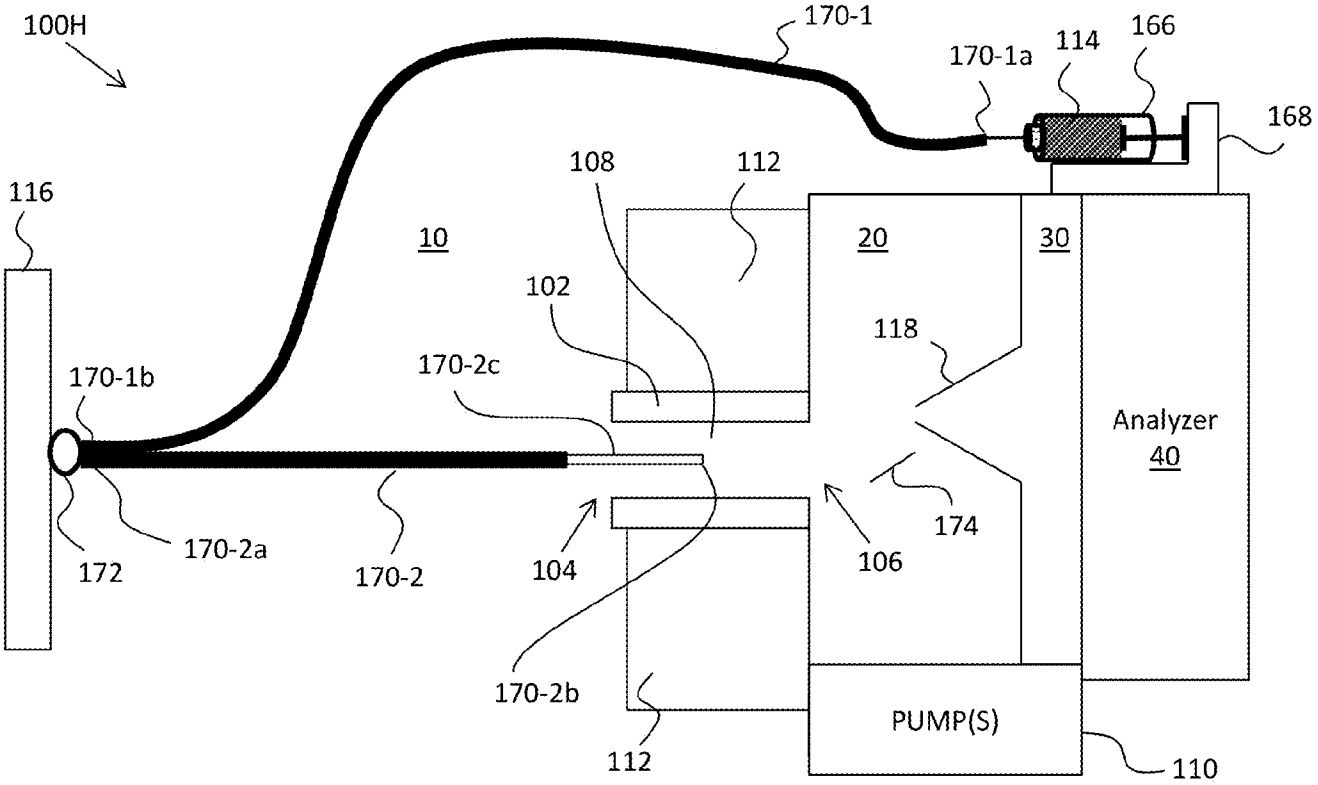
FIG. 8 illustrates another example of an improved ionization system.

FIG. 8 illustrates another embodiment of a system 100H for introducing an analyte 114 into transfer tube 102 using SAII. As shown in FIG. 8, a syringe 166 and syringe pump 168 are used to inject solvent 114 into a first tube 170-1, which may be a fused silica tubing having a polyamide coating. Examples of the solvent include, but are not limited to, water, water organic solvent mixtures, or pure organic solvents such as acetonitrile or methanol. In some embodiments, other pumping devices, such as a liquid chromatograph pump, may be substituted for the assembly of the syringe 166 and syringe pump 168.

A pressure differential is formed between a first end 170-2*a* of the second tube 170-2 and a second end 170-2*b*, which is disposed adjacent to or within channel 108 of transfer tube 102. Syringe pump 168 is configured such that solvent 114 flows into tube 170-1 at the same rate at which solvent 114 flows through capillary 170-2 due to the pressure differential between ends 170-2*a* and 170-2*b*. Solvent 114 flows through tube 170-1 and forms a liquid junction droplet 172 between ends 170-1*b* and 170-2*a*. A portion 170-2*c* of second tube 170-2 may have the polyimide coating removed to prevent ionization of gasses vaporizing from the polyimide when disposed in the heated inlet tube 102. The analyte on substrate 116 dissolves in liquid junction 172 and is received in tube 170-2 such that the entire surface of substrate 116 may be analyzed as an image by restoring the surface across the liquid junction.

Analyte can be introduced into the liquid junction droplet 172 and ionized when the solvent/analyte 114 enters the heated transfer tube 102. Besides direct introduction of analyte from a surface 116 as shown in FIG. 8, analyte can be introduced to liquid junction 172 for analysis by mass spectrometry or ion mobility spectrometry by such means as laser ablation as illustrated in FIG. 9.

Figure 9:
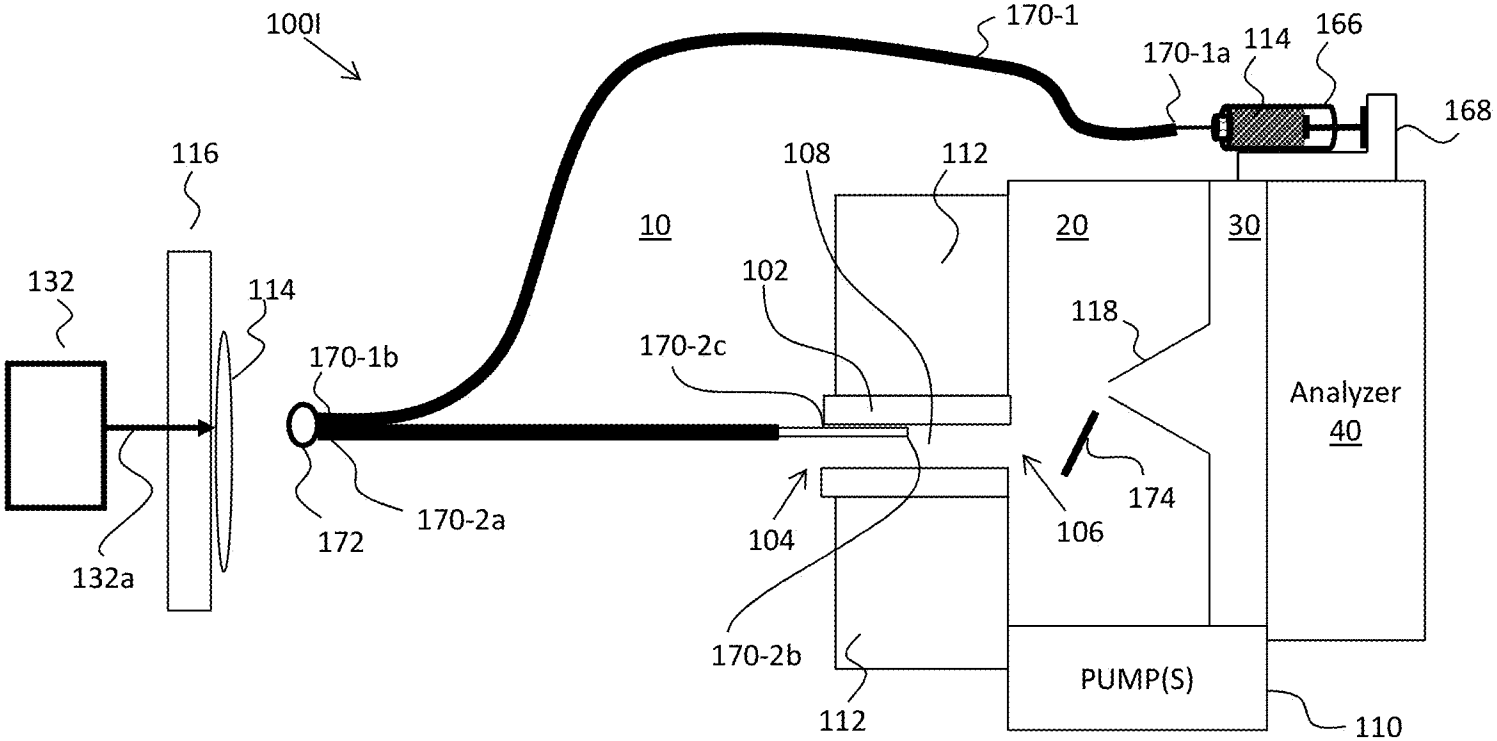
FIG. 9 illustrates another example of an improved ionization system.

As shown in FIG. 9, the system 1001 includes a laser 132 that emits a laser beam 132*a* through substrate 116, which may be a transparent sample holder such as a glass microscope slide, and into sample 114 mounted on substrate 116. The laser beam 132*a* ablates a portion of the sample in transmission geometry and the forward motion of the ablated sample carries it into the liquid junction droplet 172 where it dissolves in the solvent and is swept into the inlet channel 108 for ionization. The distance between the sample 114 and the liquid junction 172 is between 0.1 and 100 mm and more preferably between 1.0 mm and 10 mm. The sample 114 may be a tissue slice and may be mounted on plate 116 which is movable by controlled x,y,z-stages (not shown) in order to image the surface as will be understood by one skilled in the art. Laser beam 132*a* may also strike sample 114 in reflective geometry in which laser beam 132*a* does not pass through substrate 116 and thus substrate 116 may be opaque to laser beam 132*a*.

Analyte 114 may be introduced to the liquid junction 172 using other methods such as, for example, using a capillary inserted into a living rate brain in which analyte enters the flowing solvent within the capillary through osmotic flow as in microdialysis. The microdialysis solution flows directly into the liquid junction solvent droplet. Liquid junction 172 is a means for rapidly introducing the sample for ionization and analysis by mass spectrometry or ion mobility spectrometry.

An obstruction 174 may be disposed along an axis defined by inlet channel 108 of tube 102. In some embodiments, obstruction 174 is formed from metal, but one skilled in the art will understand that obstruction 174 may be formed from other materials including, but not limited to, glasses and ceramics. As shown in FIG. 9, obstruction 174 is disposed adjacent to exit 106 and is configured to increase the abundance of analyte ions observed using LSI, MAII, and SAII by intercepting any charged droplets adjacent to the entrance of skimmer 118. Obstruction 174 may also aid in the removal of some or all solvent or matrix that is received through inlet tube 102 during collision with obstruction 174 thereby increasing the analyte ions observed by the analyzer 40. An obstruction can be used in any of the ionization arrangements illustrated in FIGS. 1-10.

Figure 10:
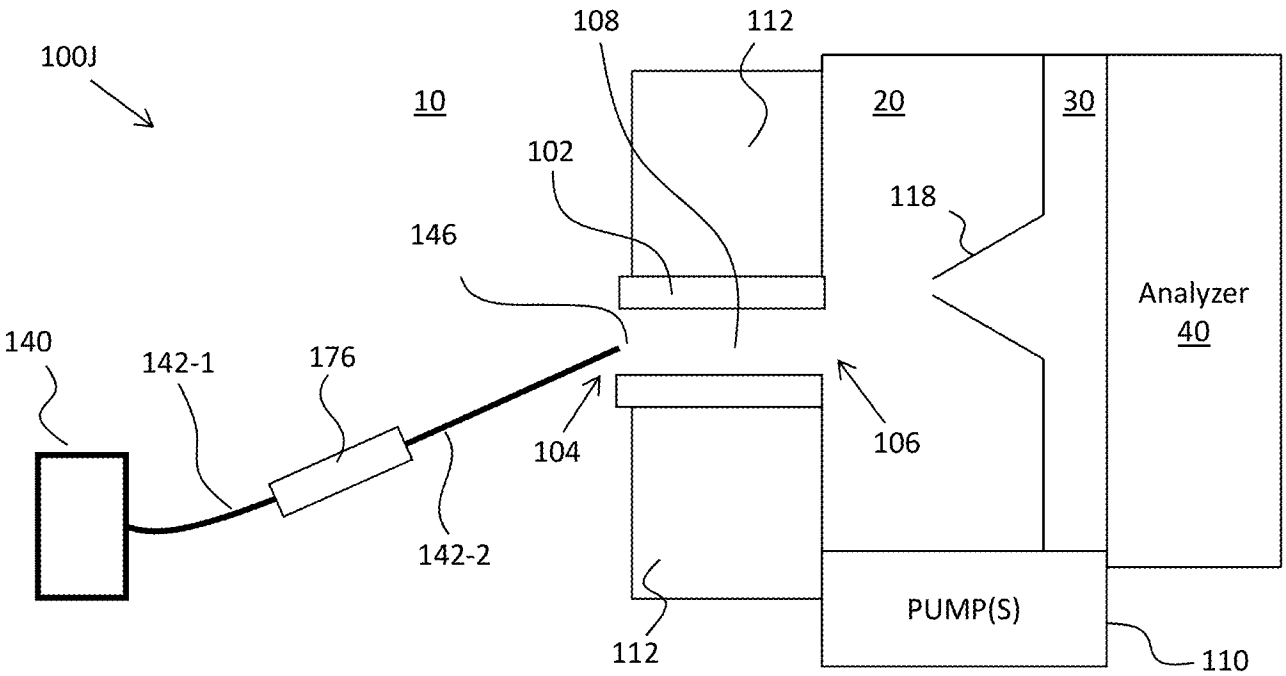
FIG. 10 illustrates another example of an improved ionization system.

FIG. 10 illustrates another embodiment of an ionization system 100J that is capable of nanoliter and microliter per minute liquid flow rates. As shown in FIG. 10, an analyte 114 is disposed within a container 140, such as a liquid chromatograph, and is in fluid contact with an LC column 176 coupled to tubing 142-1 and 142-2 (collectively referred to as "tubing"). Mobile phase of solvent 114 flows through tubing 142-1 into the LC column 176 and through tubing 142-2 where it exits at end 146. End 146 of capillary tubing 142 is positioned near the inlet opening 104 of channel 108. The flow of gas from the higher pressure region 10 to the lower pressure region 20 nebulizes the mobile phase exiting capillary 142-2 at end 146 sweeping the nebulized droplets of mobile phase solution into channel 108 for ionization.

Capillary tubing 142-2 may be disposed at an angle with respect to an axis defined by channel 108 of inlet 102. An external gas flow (not shown) may be directed at the exit end 146 of tubing 142-2 to aid the nebulization of the mobile phase liquid exiting tubing 142-2 at end 146. Tubing 142 may be, for example, fused silica or peak tubing known to those practiced in the art. The mobile phase flow rate of analyte 114 may be greater than approximately 100 nanoliters per minute.

In operation, heating device 112 of the embodiments illustrated in FIGS. 1-10 heats the transfer tube 102 to preferably between 50° C. and 600° C., more preferably between 100° C. and 500° C., and even more preferably between 150° C. and 450° C. Matrix/analyte, solvent/analyte, or analyte sample 114 is introduced into channel 108 defined by the transfer tube 102, which results in ions being produced inside channel 108 and exiting the transfer tube 102 at exit 106. The matrix/analyte, solvent/analyte, or analyte droplets or particles travel from higher pressure to lower pressure in tubing 102. Heating the transfer tube 102 and applying a matrix/analyte or analyte sample 114 to the inlet 104, which is at a higher pressure than the outlet 106, advantageously produces singly and multiply charged ions without requiring an electric field, a high velocity gas outside of the transfer tube 102, or a laser. However, one skilled in the art will understand that the application of an electric field, a high velocity gas outside of the transfer tube 102, or a laser may be utilized to introduce the matrix/analyte or analyte sample 114 to the transfer tube 102.

The ions formed within channel 108 of transfer tube 102 may be in the form of matrix or solvent droplets having a few to hundreds of charges. Evaporative loss of neutral matrix or solvent molecules within heated capillary 102 may produce bare singly or multiply charged ions observed by analyzer 40 and some portion of these charged droplets may pass through exit 106 and produce the bare singly and multiply charged ions observed in analyzer 40 by collision with a surface, such as of an obstruction 174, or by sublimation of matrix or solvent enhanced by gas collisions and fields such as radiofrequency ("RF") fields used in ion optics.

It has also been discovered that varying the gas in region 10 as well as the pressure of the gas influences the observed ion abundance. Experiments in which helium operating at slightly above atmospheric pressure have produced about a ten (10) fold increase in the ion current relative to a system in which air at atmospheric pressure is the only gas in region 10. It has also been discovered that a matrix or solvent is not necessary to produce ions from certain compounds introduced into inlet 104 of transfer capillary 102. Examples of such compounds include, but are not limited to, drugs, peptides, and proteins such as myoglobin.

In some embodiments, volatile or vaporizable materials including drugs and other small molecules introduced within inlet 104 of channel 102, using, for example, a gas chromatograph, may also be ionized producing singly charged ions if a solvent is simultaneously introduced into channel 108. The solvent 114 is ionized within channel 108 forming protonated solvent molecular ions and protonated clusters of solvent which ionize the analyte in the gas phase by ion-molecule reactions in an exothermic reaction.

EXPERIMENTATION

The Orbitrap Exactive and LTQ Orbitrap Velos mass spectrometers available from Thermo Fisher Scientific of Bremen, Germany and the Synapt G2 ion mobility mass spectrometer available from Waters of Manchester, England were used in various experiments. The Synapt G2 was operated in the ESI mode with its normal skimmer and a source temperature of 150° C. for the studies that used just the skimmer that separates atmospheric region 10 and vacuum region 20 of a z-spray ion source. Glass and metal heated transfer tubes of lengths from 1 cm to 20 cm were constructed by attaching to the skimmer cone with Sauereisen cement #P1 (Sauereisen, Pittsburgh, Pa.) and wrapping with nichrome wire that was further covered with Sauereisen cement.

The chemicals and solvents used in the experiments were obtained from Sigma Aldrich (St. Louis, Mo.) and were used without further purification. The matrix 2,5-dihydroacetophenone (2,5-DHAP) was MALDI grade but 2,5-dihydroxybenzoic acid (2,5-DHB) was 98% pure. The matrix solutions were prepared at 5 mg/mL or in the case of 2,5-DHAP as a saturated solution in 1:1 acetonitrile/water (HPLC grade). The 2,5-DHAP solution was warmed in water to increase the concentration of the solution. The matrix solution was mixed in a 1:1 ratio with the analyte solution before deposition onto the target plate using the dried droplet method. Peptides and proteins were dissolve in water with the exception that bovine insulin was first dissolved in a 1:1 methanol/water solution and then diluted in pure water.

The methods of transferring sample to the skimmer or ion transfer tube were by use of a sharp point of a sewing needle to transfer a small amount of the sample, a laboratory spatula, and a melting point tube or glass microscope slide and gently tapping the area with matrix/analyte applied against the ion entrance aperture of the mass spectrometer.

An experiment was also performed in which an aluminum plate 3/16" thickness was mounted within 3 mm of the ion entrance aperture with the sample aligned with the orifice. In one case an air rifle BB gun was used to fire metal pellets at the plate directly behind the sample. For safety a section of rubber tubing extended past the barrel and was pushed against the plate to catch the projectile and the operator wore a face shield.

Another experiment was also performed utilizing a center punch device to generate the shockwave on the substrate 116. A Lisle (Lisle Corporation, Clarinda, Iowa) automatic center punch was used to impart the shockwave in some studies by pushing the punch device against the plate opposite the sample until it automatically fired producing a shockwave.

Multiply charged ions of peptides and proteins, for example, are also produced from matrix/analyte mixtures using ultrasonic devices and laser induced acoustic desorption to transfer the sample to the ion entrance capillary 102 or skimmer entrance 118. In another experiment, various analytes were introduced into a transfer capillary 102 disposed in various gases including air, argon, helium, and nitrogen. The analytes, which include 2,5-dihydroxyacetophenone (DHAP), buspirone hydrochloride, the drug Lavaquin®, angiotensin II, and myoglobin were introduced to the transfer capillary without the presence of a matrix.

Experiments were performed in which an analyte was introduced into a transfer capillary 102 using SAII. In one experiment, the analyte/solvent was 3.44 femtomoles per microliter of insulin in water. The analyte/solvent was introduced into the transfer capillary 102 at a flow rate of approximately 10 μL/minute until 280 amol was consumed. A single 0.5 second scan was performed. A similar experiment was performed in which the analyte was introduced into the transfer capillary 102 using electrospray ionization, and the results comparing these two experiments are described below.

Other experiments using the SAII method involved the peptide bradykinin (MW 1060) dissolved in water. The limit of detection was $<1\times10^{-15}$ moles (100 zeptamoles). Introduction of vapors of triethylamine into the heated transfer capillary between the high and the low pressure regions resulted in formation of the protonated molecular ions in good abundance. Introducing a flow of pure water into the heated conduit with a flow rate greater than 100 nanoliters per minute created ions that resulted in protonation of neutral compounds introduced into the transfer capillary from a gas chromatograph with high sensitivity. Ions of lipids in tissue were produced by introducing a flow of water into the heated inlet transfer capillary and at the same time ablating mouse liver tissue slices using an infrared laser. The point of ablation was near the atmospheric pressure entrance to the transfer capillary so that ablated material entered the transfer capillary along with the water flow. A liquid junction formed at the intersection of two concentric fused silica capillaries, one with a solvent flow from an infusion pump and exit end of the other inserted into the heated inlet transfer tube, was used as a surface sampler to detect compounds on surfaces such as mouse brain tissue.

The infusion of solvent through one fused-silica tube was balanced by the flow through the second fused-silica tube by the pressure difference between the entrance end and the exit end in the transfer tube such that a liquid droplet was maintained between the exit end of one and the entrance end of the other fused-silica tubes. For example, pesticides were readily detected from the surface of fruits by touching the liquid junction droplet against the fruit surface. Imaging of surfaces, such as biological tissue, with the liquid junction is also contemplated.

A Waters NanoAcquity capillary liquid chromatograph was used to deliver mobile phase in a reverse phase gradient to C18 columns of 1 mm and 0.1 mm inner diameter by 100 mm length running at flow rates of 55 and 0.8 microliters per minute. Injection of 1 picomole of a bovine serum albumin ("BSA") digest into the 55 μL flow or 10 femtomole of BSA into the 0.8 μL flow resulted in excellent quality separation and detection of the BSA tryptic peptides.

EXPERIMENTAL RESULTS

Figure 11:
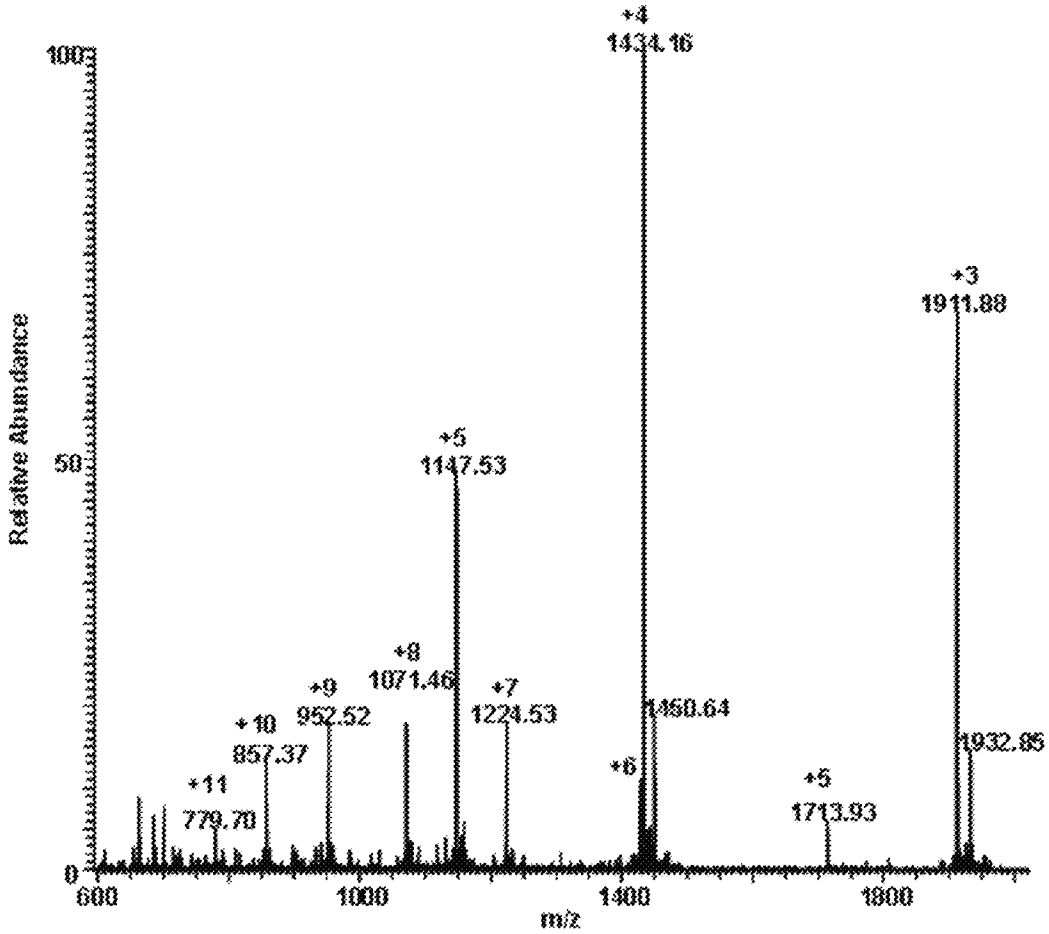
FIG. 11 is a mass spectrum of a mixture of proteins ubiquitin and insulin in 2,5-dihydroxyacetophenone as a matrix obtained by using the ionizing system illustrated in FIG. 1.

FIG. 11 illustrates the mass spectrum of a mixture of the proteins ubiquitin (having a molecular weight (MW) of 8562) and insulin (MW 5729) obtained through the system and method described above with respect to FIG. 1 using 2,5-DHAP as the matrix applied to a metal spatula as substrate 116 and the transfer capillary 102 heated to 350° C. by heater 112. About 3 picomoles of ubiquitin and 10 picomoles of insulin were in about 3 micromoles of 2,5-DHAP matrix and the dried mixture 114 was introduced to the transfer tube 102 to produce the ions shown. The charge states +5 to +11 for ubiquitin and +3 to +5 for insulin are labeled.

Figure 12:
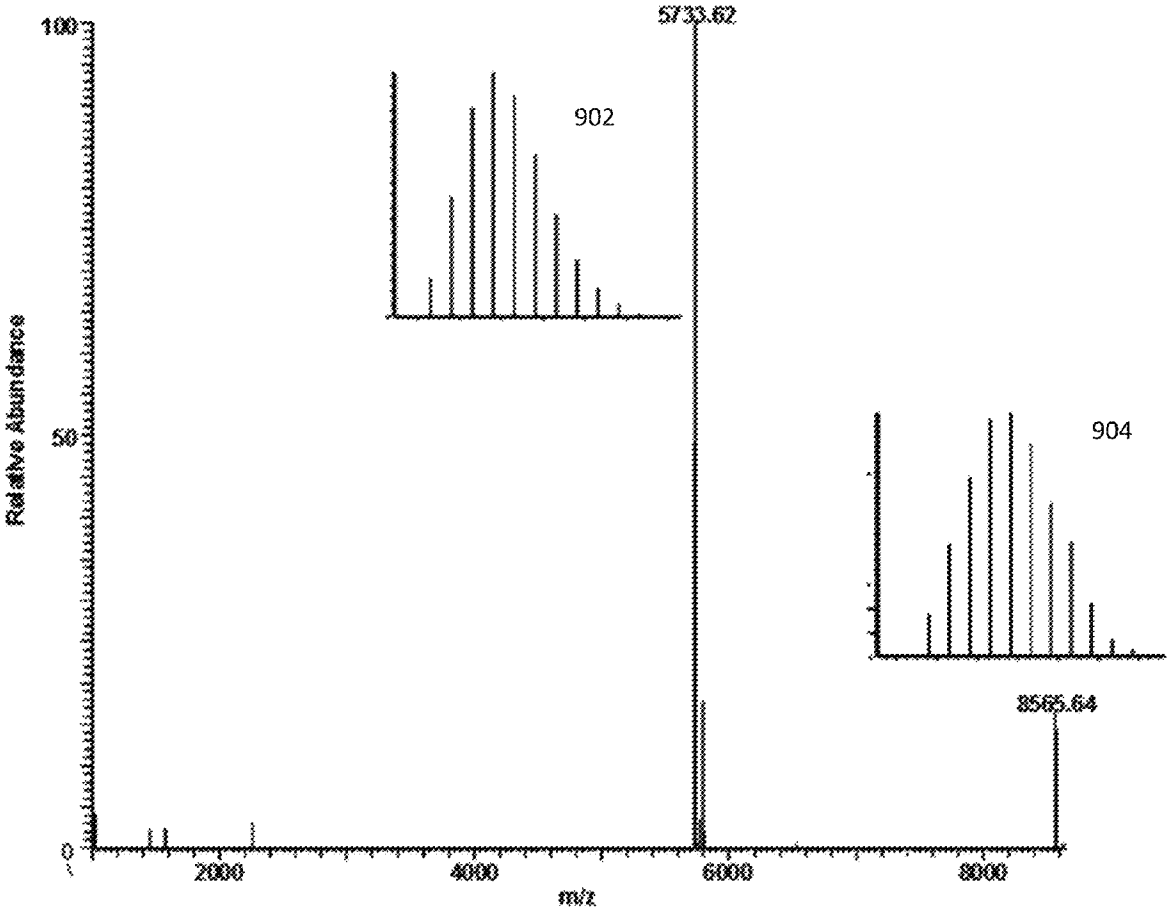
FIG. 12 is a computer deconvolution of the multiply charged spectrum illustrated in FIG. 11.

FIG. 12 is the computer deconvolution of the multiply charged spectrum in FIG. 11 providing the singly charged representation of the molecular ions generated from the multiply charged ions. Inset 902 in FIG. 12 is the isotope distribution for the insulin MH+ ion, and inset 904 in FIG. 12 is the isotopic distribution for the ubiquitin MH+ molecular ion.

Figure 13:
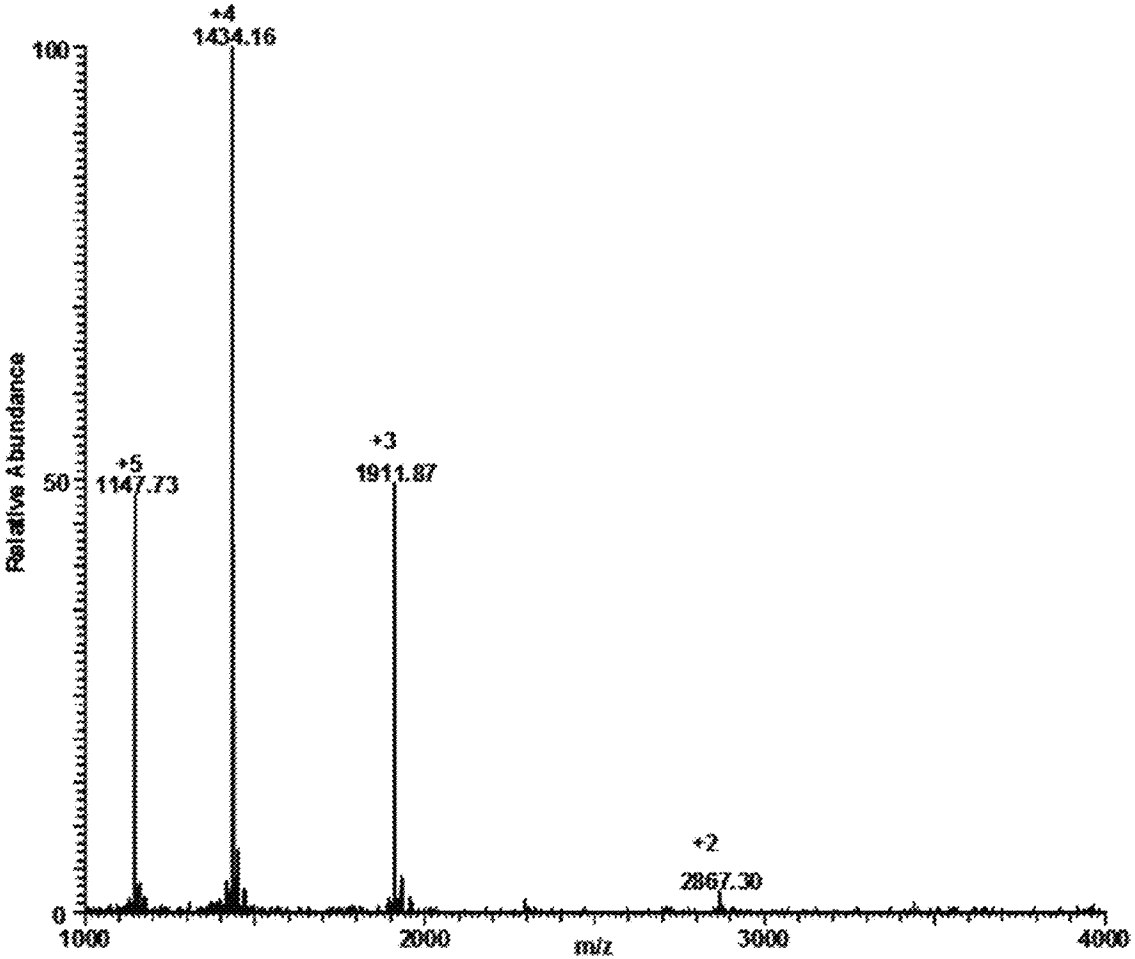
FIG. 13 is the multiply charged mass spectra obtained for insulin in the matrix 2,5-dihydroxyacetophenone in accordance with the ionizing system illustrated in FIG. 1.

FIG. 13 illustrates the multiply charged mass spectra obtained for insulin using 2,5-DHAP as matrix with a transfer tube 102 temperature of 350° C. and applying the sample to the inlet 104 of the transfer tube 102 using matrix/analyte 114 applied to a glass melting point tube as the substrate 116.

Figure 14:
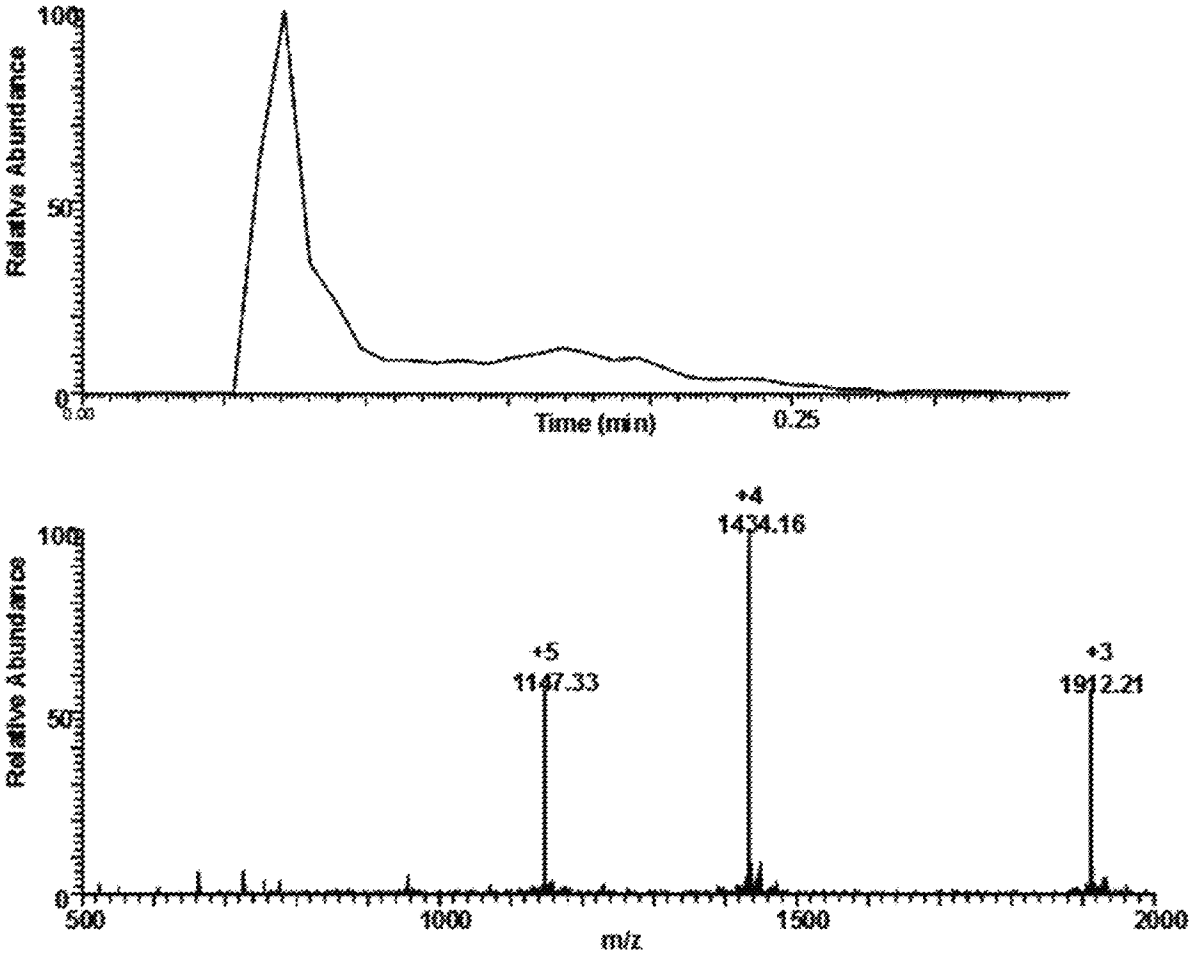
FIG. 14 illustrates the mass spectrum of insulin in the matrix 2,5-dihydroxyacetophenone obtained using the improved ionizing system illustrated in FIG. 1.

FIG. 14 illustrates the mass spectrum of insulin (bottom) in the matrix 2,5-DHAP with the transfer tube 102 temperature set for 180° C. The selected ion current chromatogram for the +4 charge state ion at m/z 1434 is plotted on top of FIG. 14. The apex of the chromatogram represents the acquisition immediately following when the sample 114 on a metal spatula 116 was touched against the entrance 104 of the transfer tube 102. At 180° C., the ion current diminished slowly. However, the apex ion current decreases with decreasing temperature.

Figure 15:
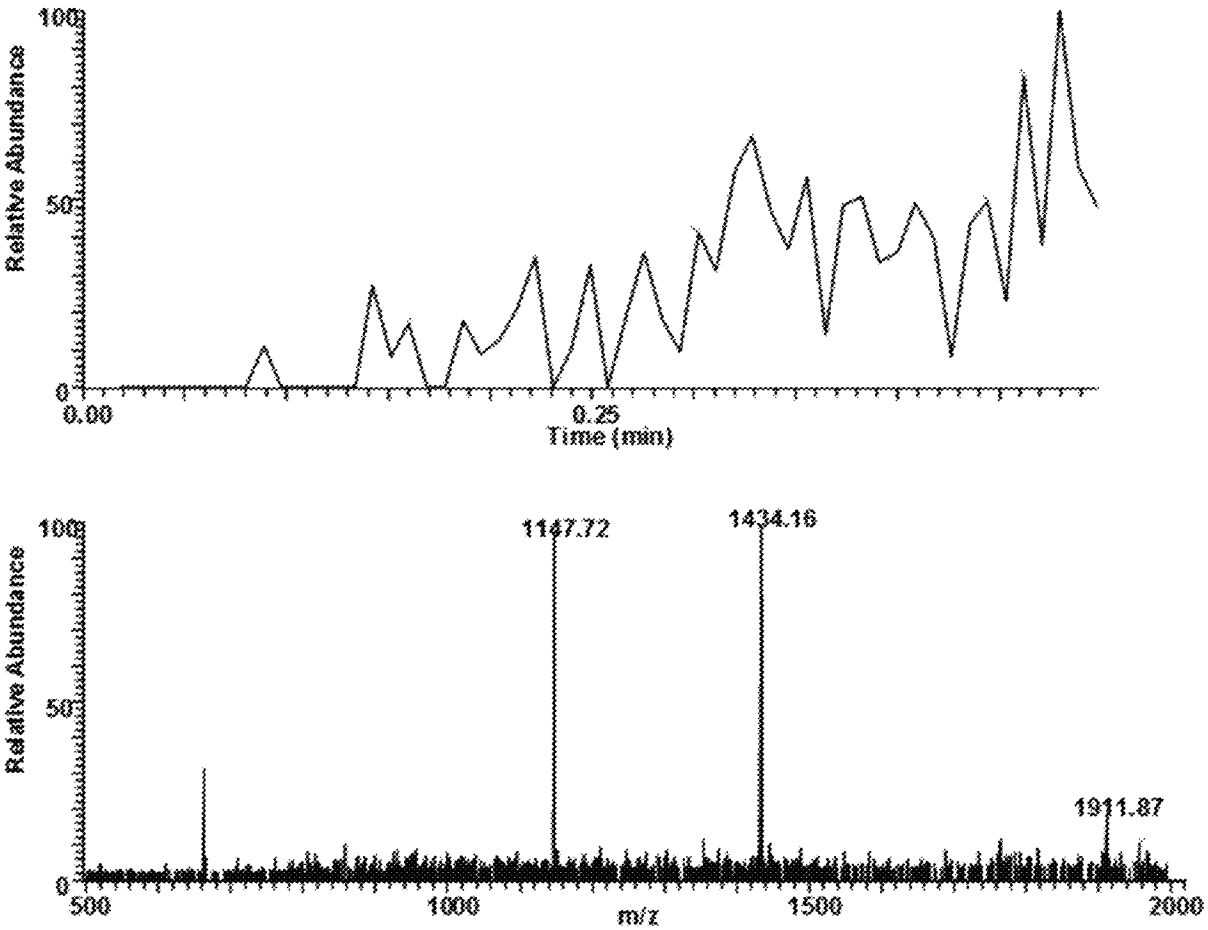
FIG. 15 is illustrates the mass spectrum of insulin in the matrix 2,5-dihydroxyacetophenone obtained using the improved ionizing system illustrated in FIG. 1 when the capillary tube is heated to a different temperature.

FIG. 15 is similar to FIG. 14 except that the transfer tube 102 was heated to 150° C. by heater 112. For peptides, multiply charged ions are observed with capillary temperature as low as 40° C. with detectable abundance using the more volatile matrix 2,5-DHAP.

Figure 16:
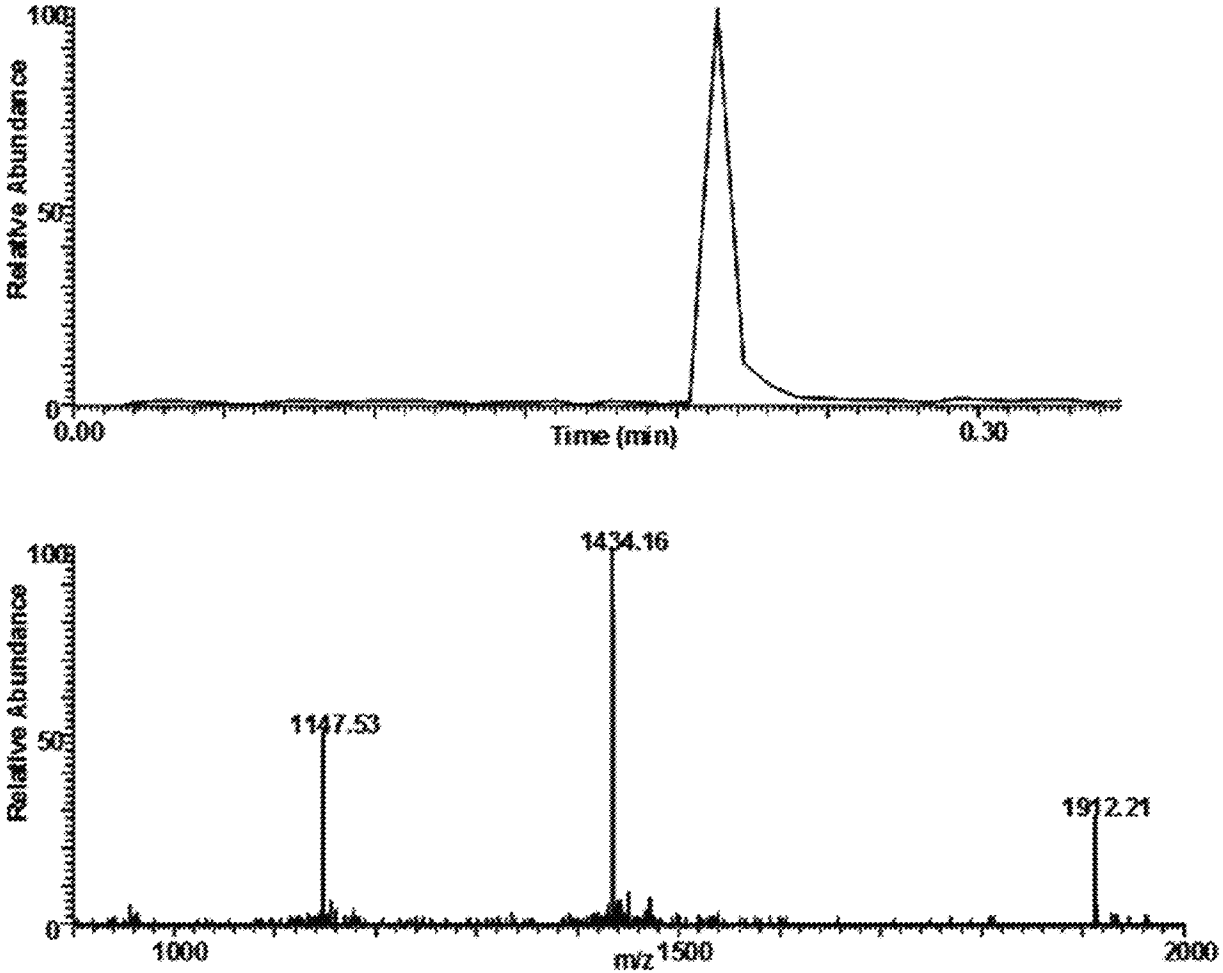
FIG. 16 illustrates the total ion current chromatogram from impact of an aluminum plate in accordance with FIG. 2 by a carpenter's center punch device to dislodge a sample of 2,5-dihydroxyacetophenone matrix with 1 picomole of insulin applied to the plate using the dried droplet method.

FIG. 16 illustrates the total ion current chromatogram from impact on an aluminum plate (e.g., substrate 116 in FIG. 2) by a carpenter's center punch device 132 to dislodge a sample of 2,5-DHAP matrix with 1 picomole of insulin applied to the plate 116 using the dried droplet method. The bottom portion of FIG. 16 illustrates the mass spectrum obtained from the single acquisition at the peak of the apex in the total ion current chromatogram (top of FIG. 16) showing the multiple charged ions of insulin.

Figure 17:
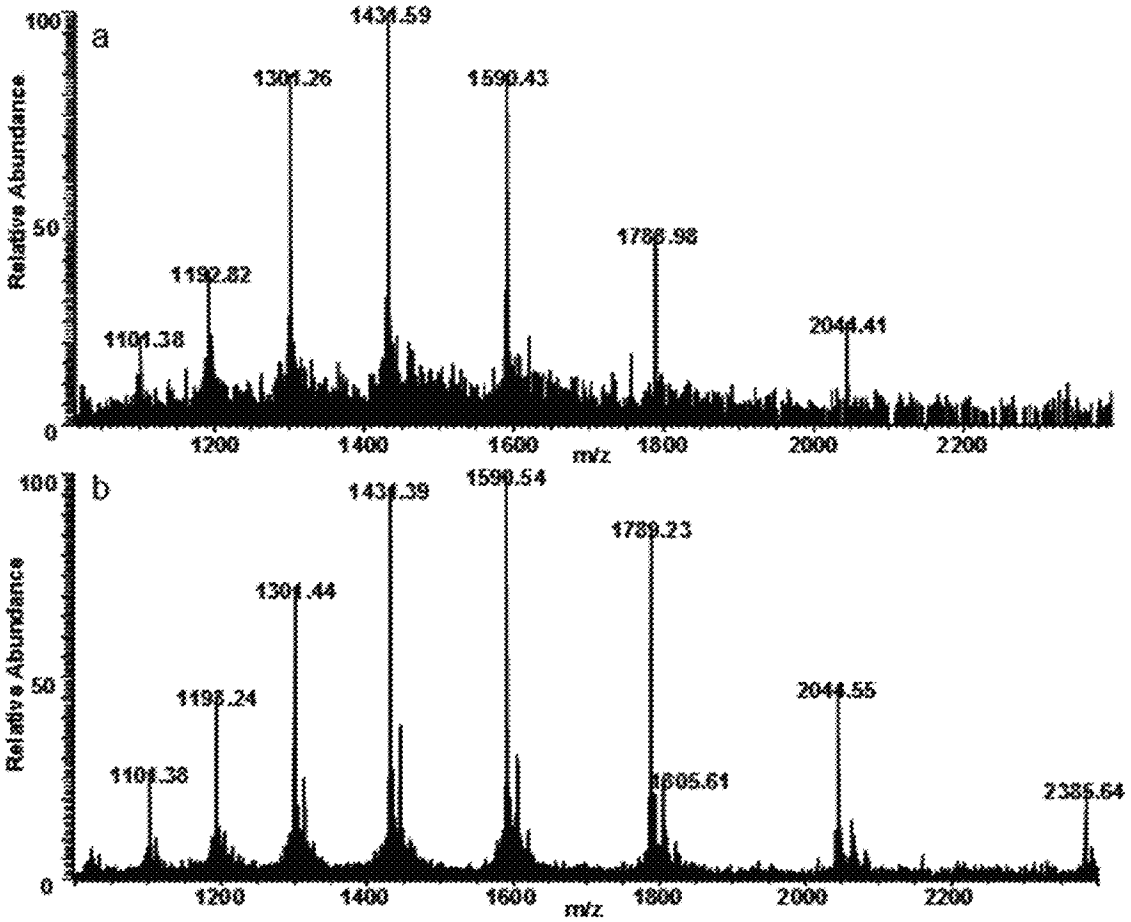
FIG. 17 illustrates the mass spectrum of lysozyme, a protein of MW>14,300, (a) obtained by the method described here using the center punch device to create a shockwave on a 3/16 inch thick aluminum plate; and (b) using laser ablation in transmission geometry for the laser beam with the plate being a glass microscope slide as in laserspray ionization.

FIG. 17 illustrates the mass spectrum of lysozyme, a protein of MW>14,300, (a) obtained by the method described here using the center punch device 132 to create a shockwave on a 3/16 inch thick plate 116; and (b) using laser ablation with the plate 132 being a glass microscope slide as in LSI. 2,5-DHAP and a transfer tube temperature of 325° C. were used to obtain both mass spectra. The ions observed are +7 to +13 for the center punch method and +6 to +13 for the laser ablation method.

Figure 18:
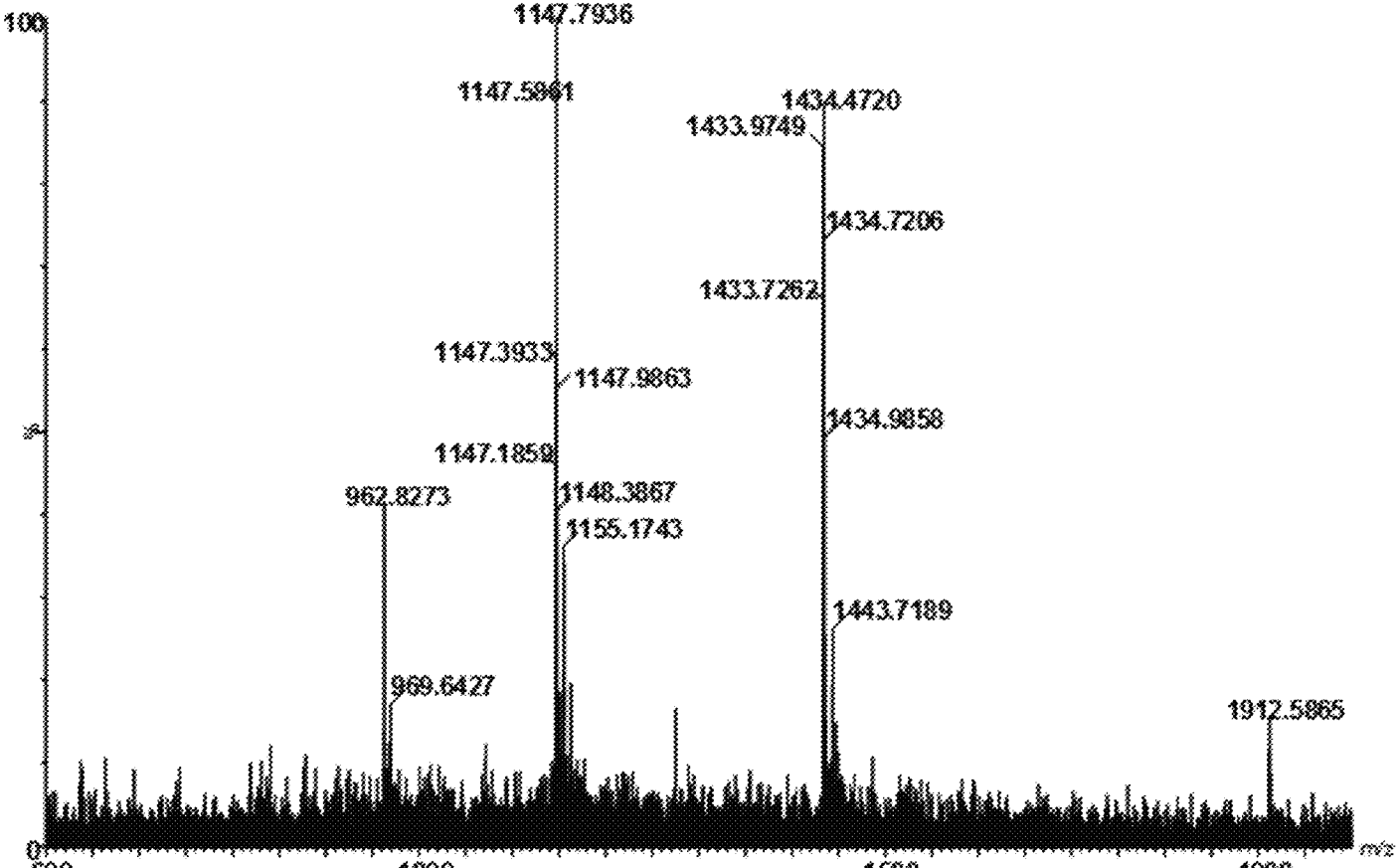
FIG. 18 illustrates the mass spectrum of the multiply charged ions of 1 picomole of insulin in 2,5-DHAP matrix in accordance with the ionizing system illustrated in FIG. 4.

FIG. 18 illustrates the mass spectrum obtained on a Waters Synapt G2 ion mobility mass spectrometer for the multiply charged ions of 1 picomole of insulin in 2,5-DHAP matrix where the transfer device is a skimmer 134 instead of a transfer tube 102 in accordance with FIG. 4. The spectrum was obtained with a skimmer temperature set to 150° C.

Figure 19:
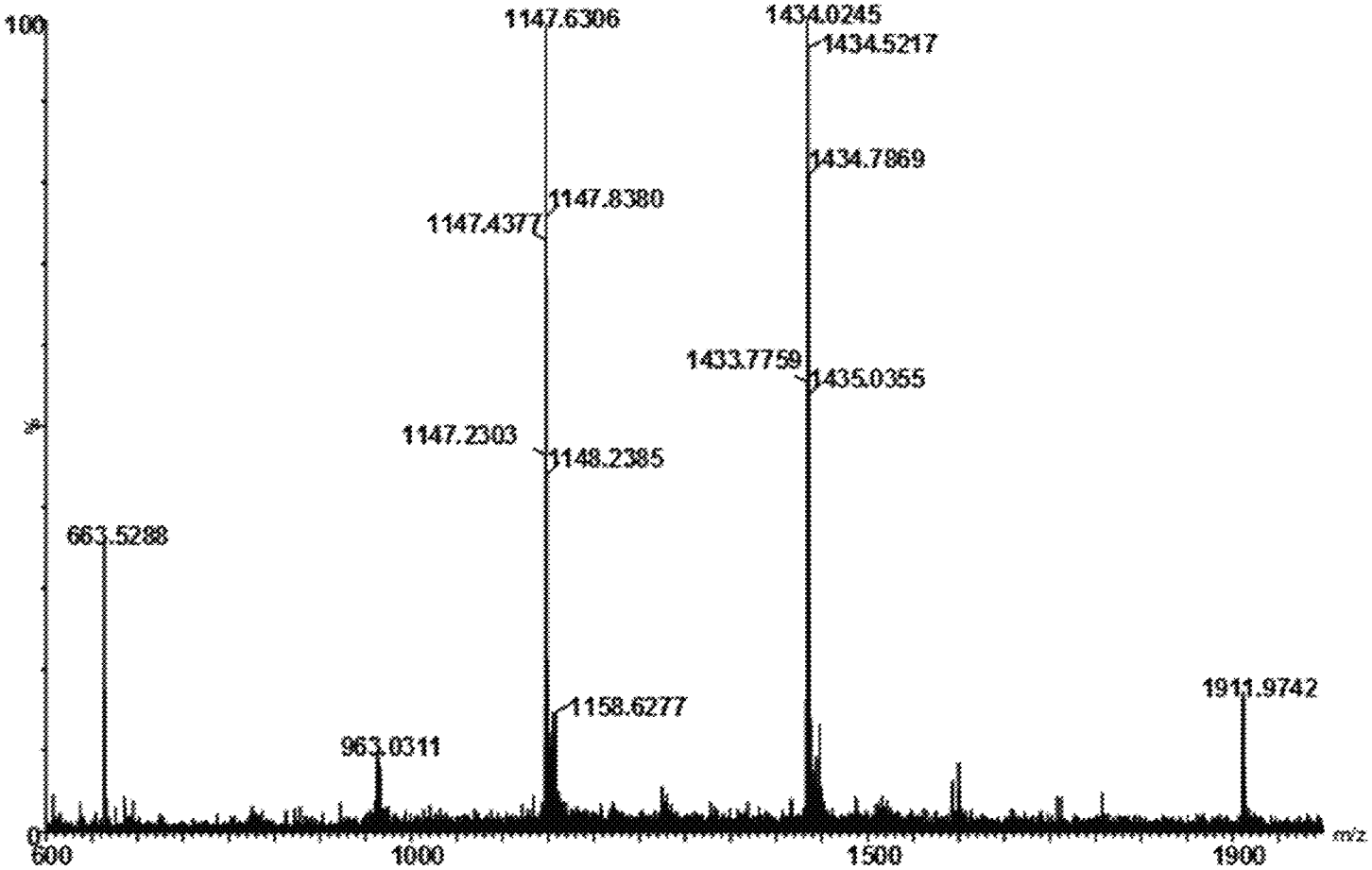
FIG. 19 illustrates the mass spectrum of 1 picomole of insulin in accordance with the ionizing system illustrated in FIG. 4 with the heater set to 150° C.

FIG. 19 illustrates the mass spectrum obtained on the Synapt G2 of 1 picomole of insulin by attaching a piece of 3/4 inch long by 1/16 inch inner diameter ("ID") glass tubing to the skimmer 134 with the heater 112 set to 150° C. Changing the tubing to 4 inch copper tubing gives a similar mass spectrum (not shown).

Figure 20:
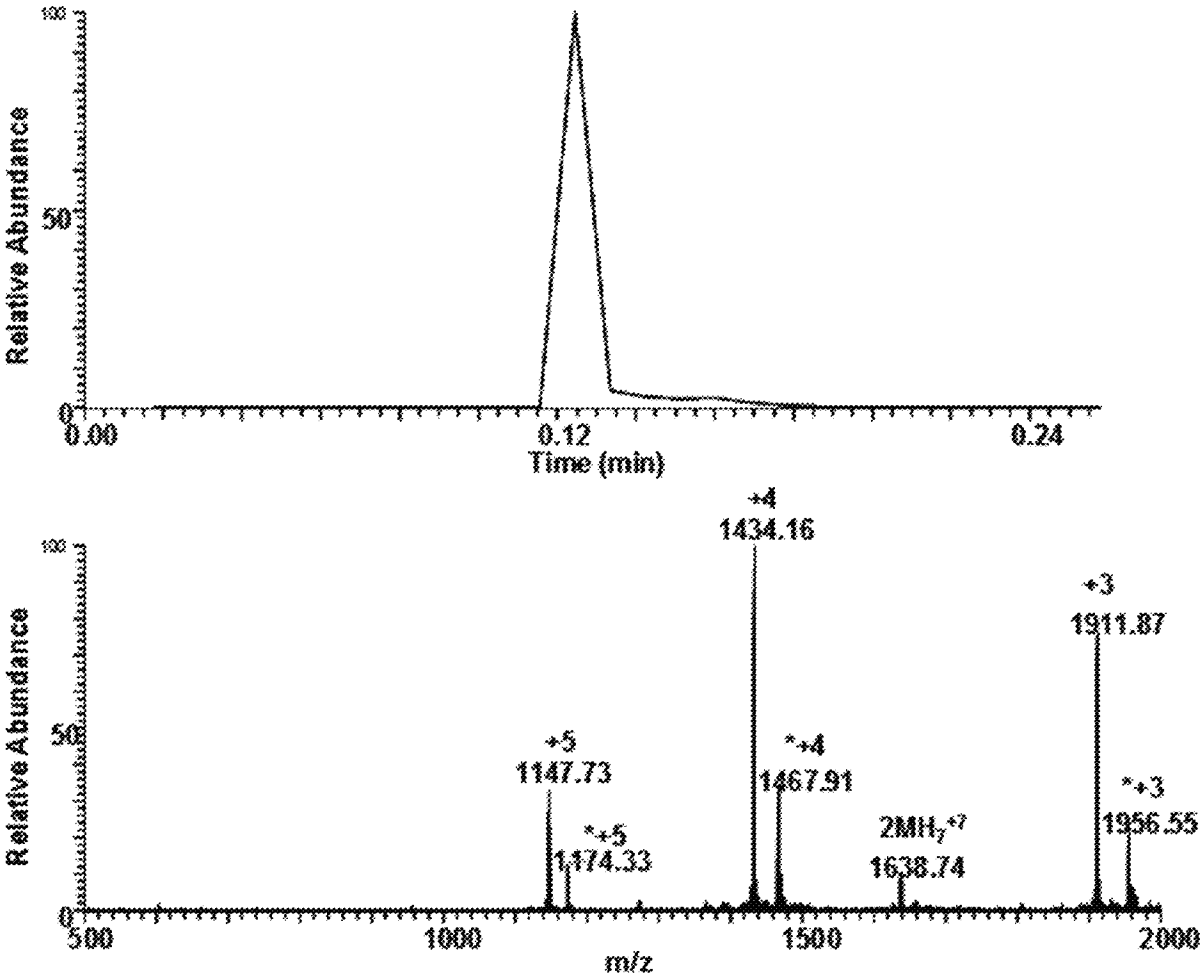
FIG. 20 illustrates the mass spectrum of insulin obtained with the ion transfer arrangement shown in FIG. 1 with an input device coupled to the entrance of the transfer tube such as the one illustrated in FIG. 2.

FIG. 20 illustrates the mass spectrum of insulin obtained on the Orbitrap Exactive with an ion transfer arrangement in accordance with the one illustrated in FIG. 2 with cone device 120 attached to entrance 104 and where an ultrasonic probe was used as substrate 116 for transferring the matrix/analyte sample 114 to the ionization region 108.

Figure 21A:
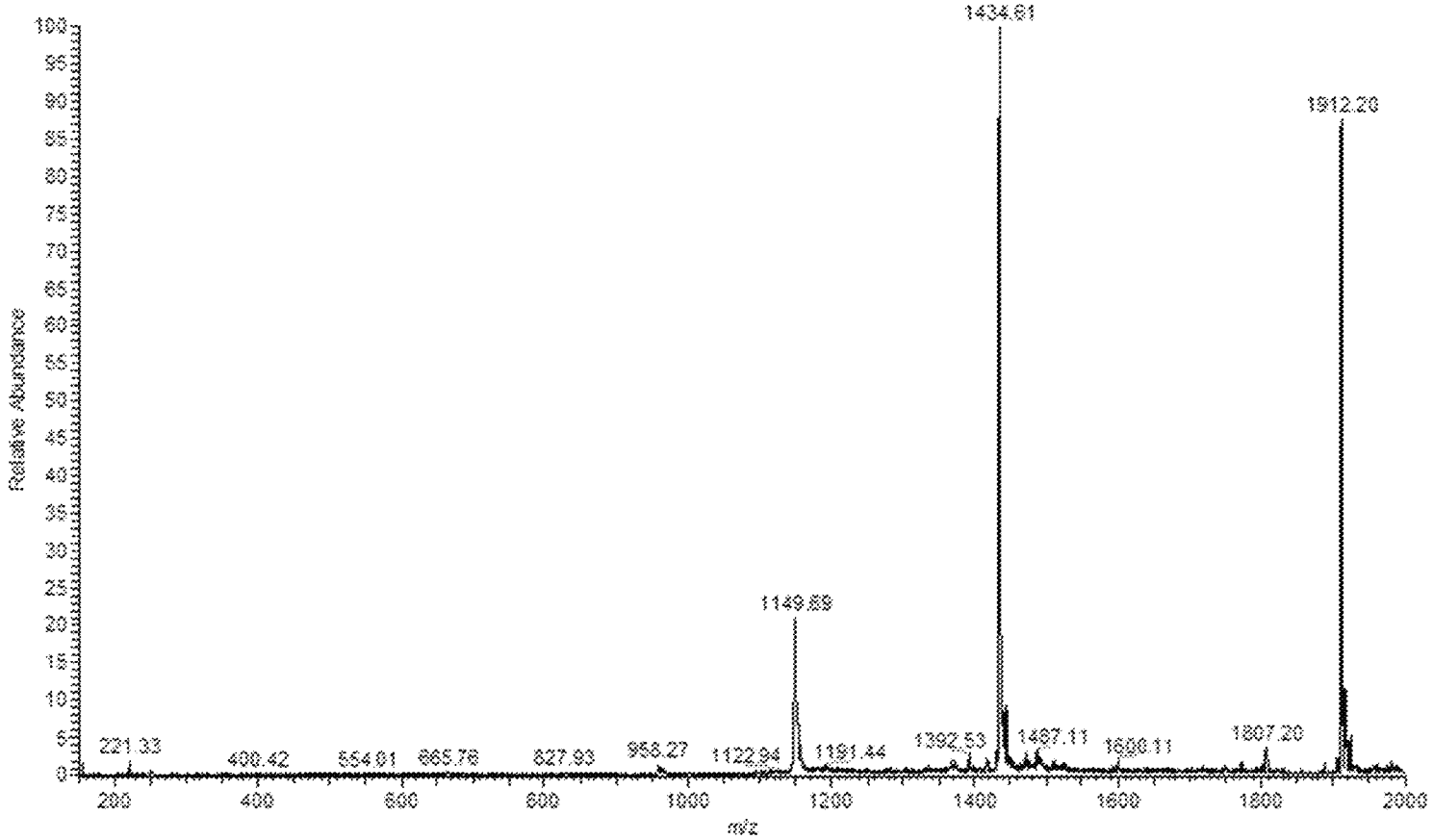
FIG. 21A illustrates the mass spectrum of insulin in the matrix 2.5-DHAP introduced to system in accordance with FIG. 1 in air at atmospheric pressure.
Figure 21B:
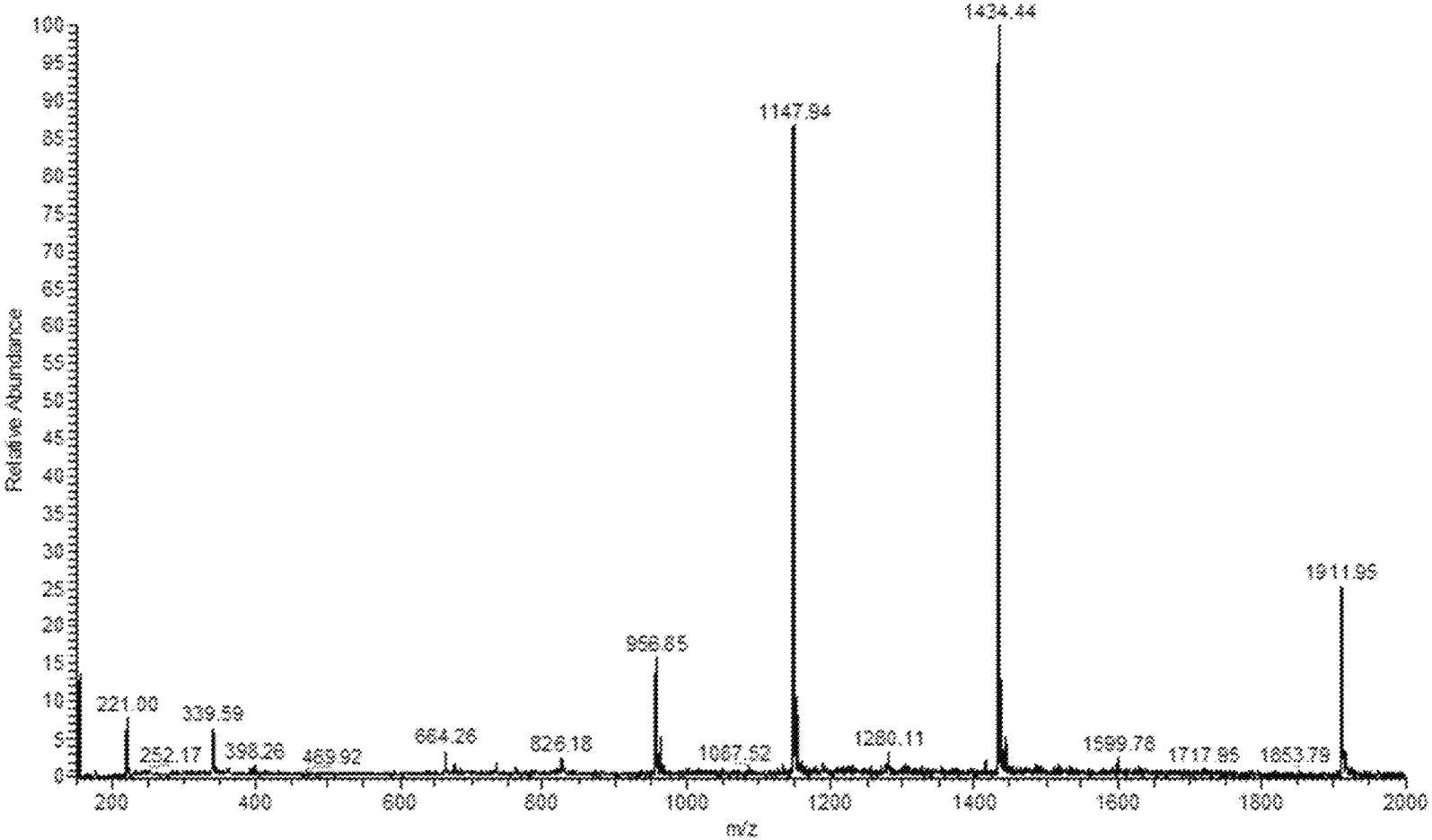
FIG. 21B illustrates the mass spectrum of the sample of insulin in matrix as in FIG. 21A introduced to a system in accordance with FIG. 1 in helium at slightly above atmospheric pressure.

FIG. 21A illustrates the mass spectrum of insulin introduced to a transfer capillary in 2,5-DHAP matrix and obtained when the mass spectrometer ion transfer inlet was disposed in air at atmospheric pressure, and FIG. 21B illustrates the mass spectrum of insulin introduced to a transfer capillary in the matrix 2,5-DHAP with the assistance of helium gas having a pressure slightly above atmospheric in region 10. The matrix/analyte sample 114 for FIGS. 21A and 21B were the same sample preparation. Comparing FIGS. 21A and 21B demonstrates that the multiply charged mass spectrum of insulin showing charge states +3 to +6 in FIG. 21B is greater than ten (10) times more ion abundant than in FIG. 21A.

Figure 22:
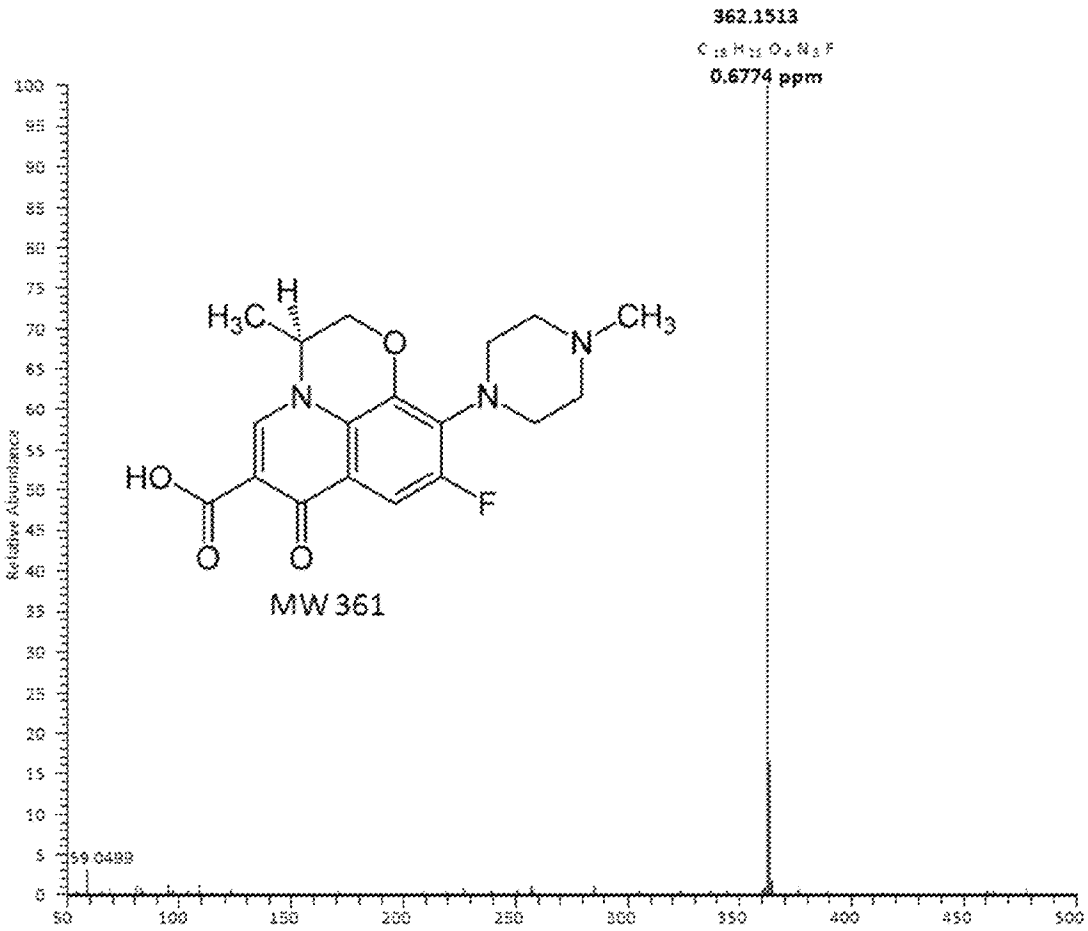
FIG. 22 illustrates the mass spectrum of Lavaquin introduced into a channel heated to 350° C. and linking a high pressure to a low pressure in the presence of air without the use of a matrix.

FIG. 22 illustrates the mass spectrum of Lavaquin introduced into the inlet 104 of a transfer capillary 102 heated to 350° C. by heater 112 and at atmospheric pressure in the presence of air without the use of a matrix.

Figure 23:
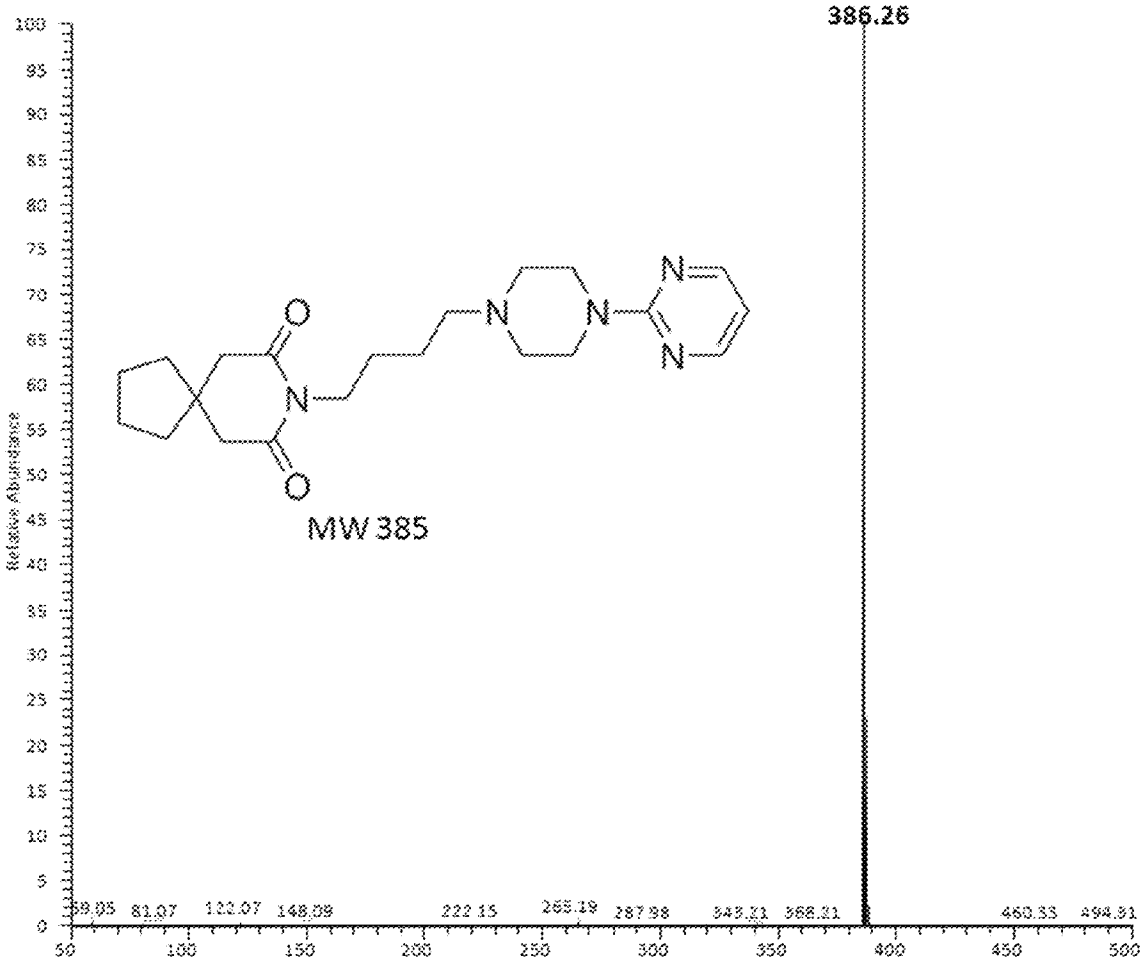
FIG. 23 illustrates the mass spectrum of buspirone hydrochloride introduced using a spatula into a heated channel at atmospheric pressure that links to a low pressure in the presence of air without the use of a matrix.

FIG. 23 illustrates the mass spectrum of buspirone hydrochloride touched against the inlet 104 of a transfer capillary 104 using a spatula 116 at atmospheric pressure in the presence of air without the use of a matrix.

Figure 24:
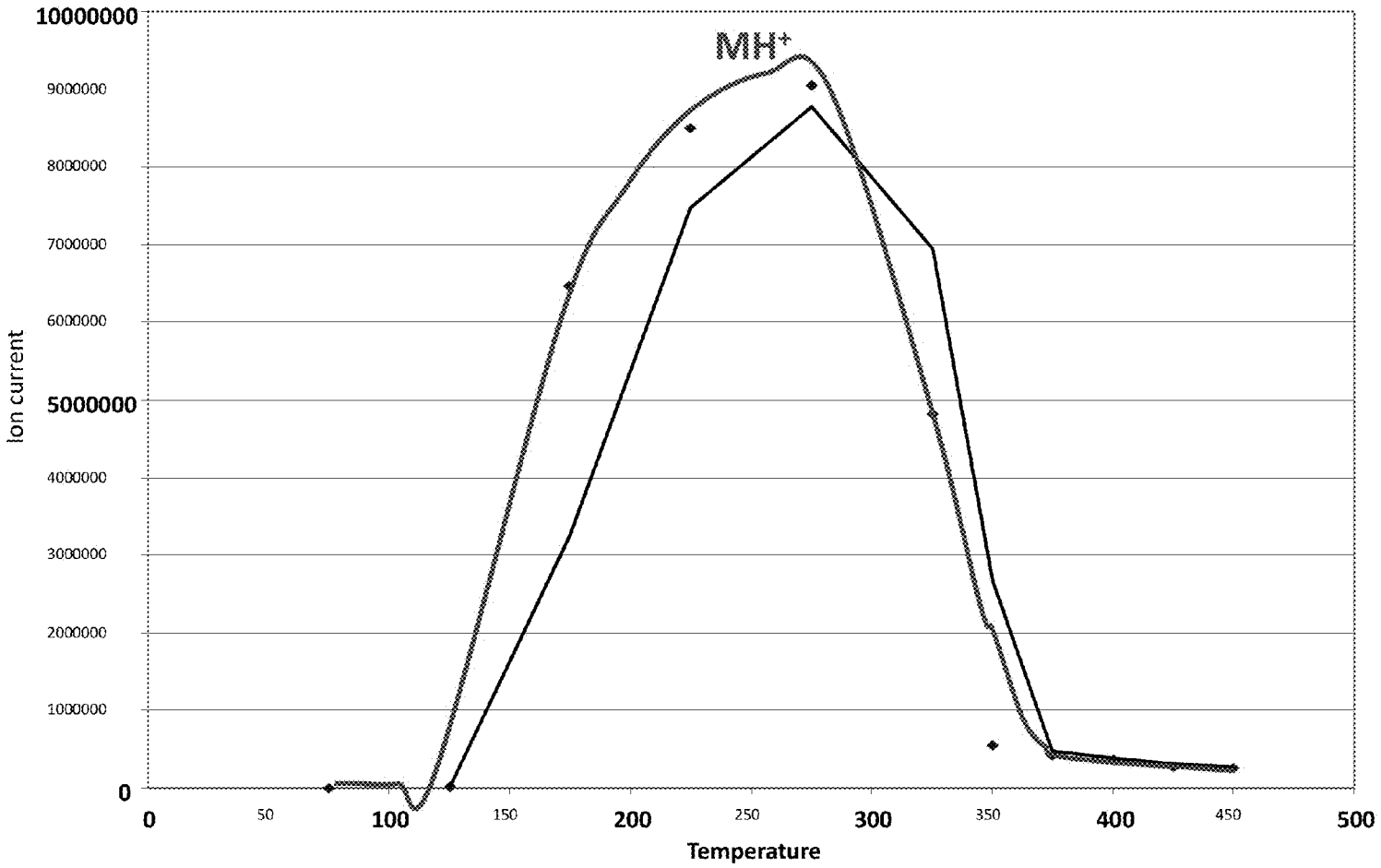
FIG. 24 illustrates the ion entrance temperature profile versus ion abundance of 2,5-dihydroxyacetophenone.

FIG. 24 illustrates the temperature profile of 2,5-DHAP. More specifically, FIG. 24 illustrates the ion abundance of $MH^+$ ions versus the temperature of the ion entrance transfer capillary 102. As shown in FIG. 24, the ion abundance of $MH^+$ ions increases as the temperature of the transfer capillary 102 is heated to a certain temperature after which the ion abundance decreases as the temperature continues to increase. Sample introduction was achieved at each temperature independently.

Figure 25A:
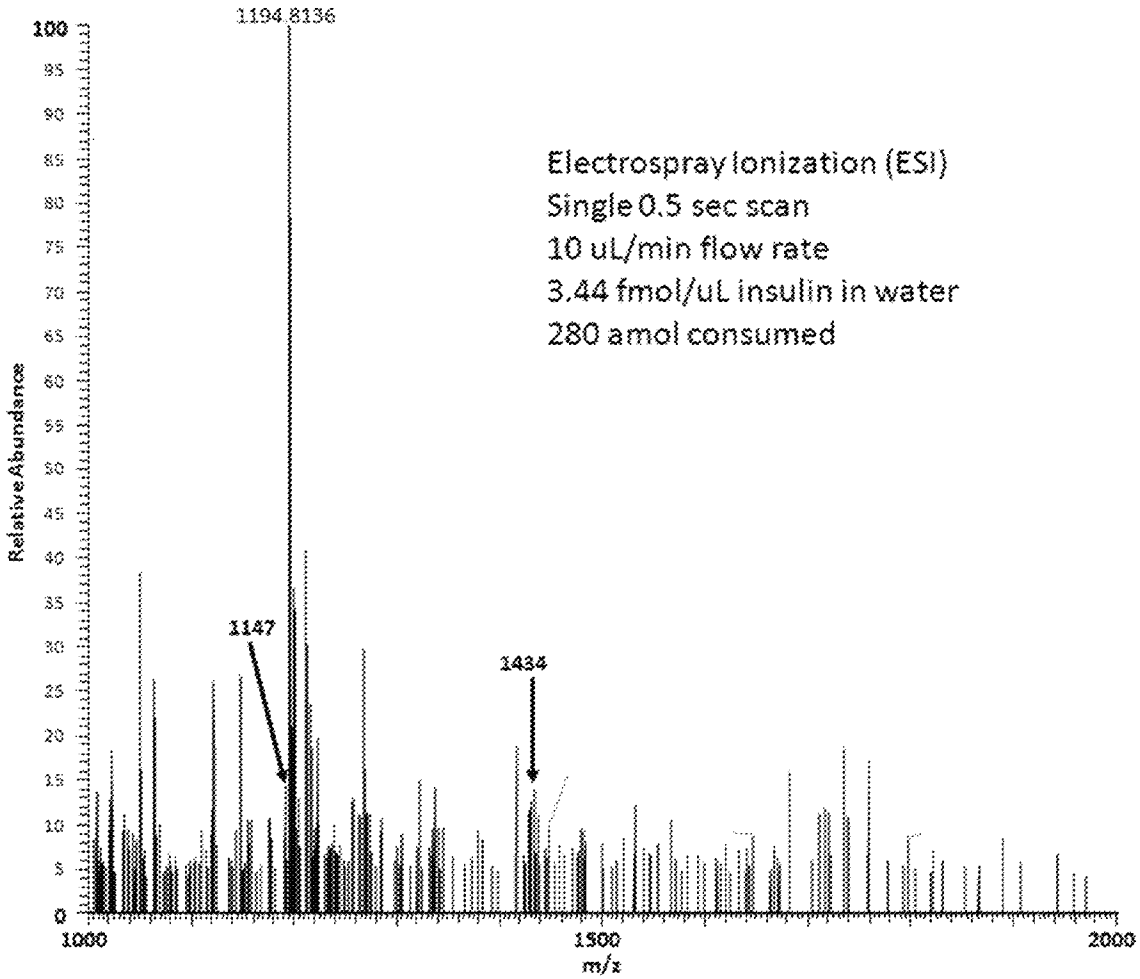
FIG. 25A illustrates the mass spectrum of a single acquisition of a solution of 3.44 femtomoles of insulin in water using electrospray ionizing at a solvent flow rate of 10 microliters per minute with masses 1147 and 1434 being associated with insulin.
Figure 25B:
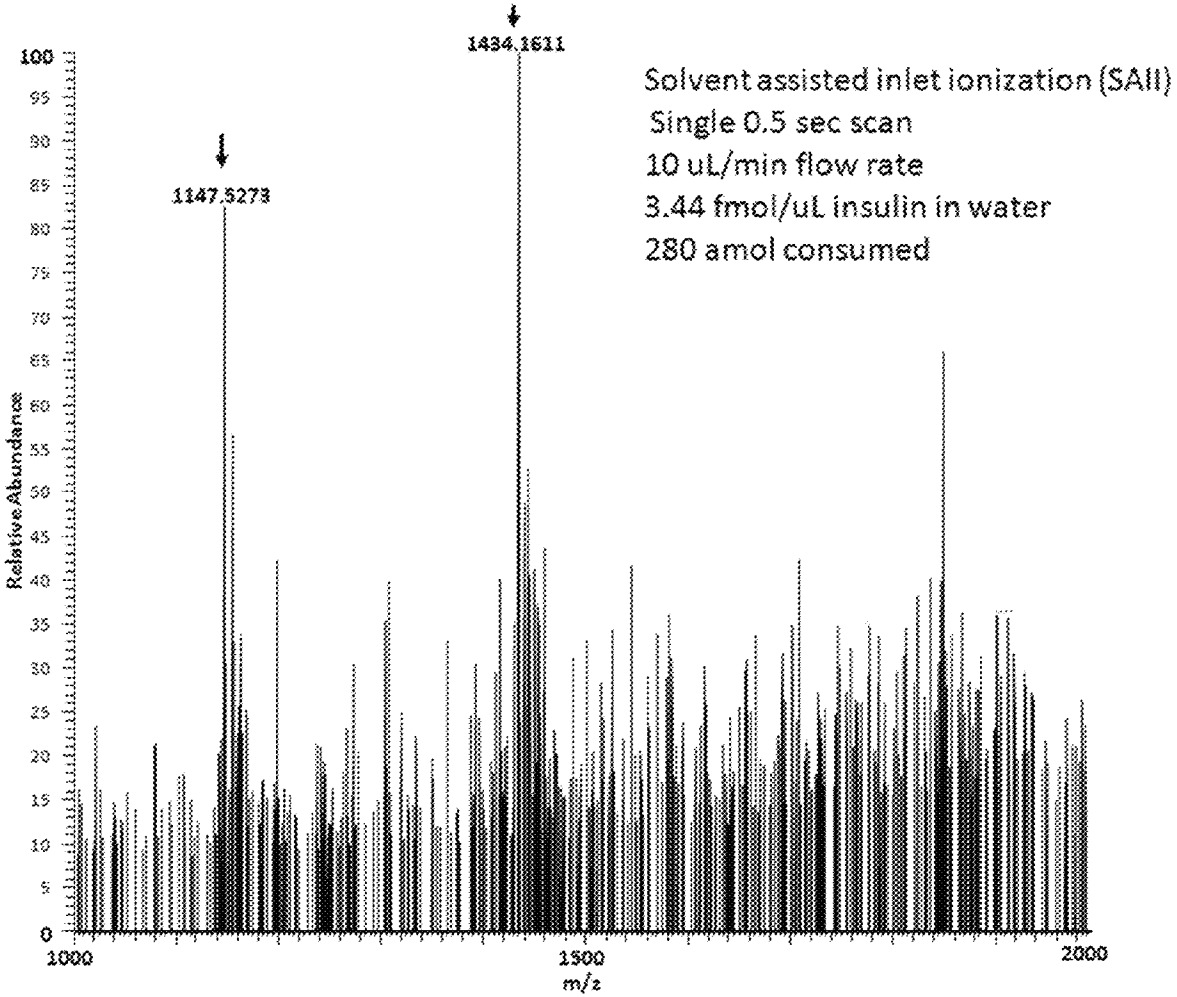
FIG. 25B illustrates the mass spectrum of a single acquisition of a solution of 3.44 femtomoles of insulin in water introduced into a heated inlet using a solvent assisted inlet ionization method under the same instrument tune conditions used in FIG. 25A for electrospray ionization.

FIG. 25A illustrates the mass spectrum of a single acquisition of a solution of 3.44 femtomoles of insulin in water that was electrosprayed at 10 microliters per minute. FIG. 25B illustrates the mass spectrum of a single acquisition of a solution of 3.44 femtomoles of insulin in water introduced to a heated transfer capillary using SAII. As can be seen by comparing FIGS. 25A and 25B, the levels of insulin (lines 1147 and 1434) are substantially greater when using SAII compared to ESI.

Figure 26:
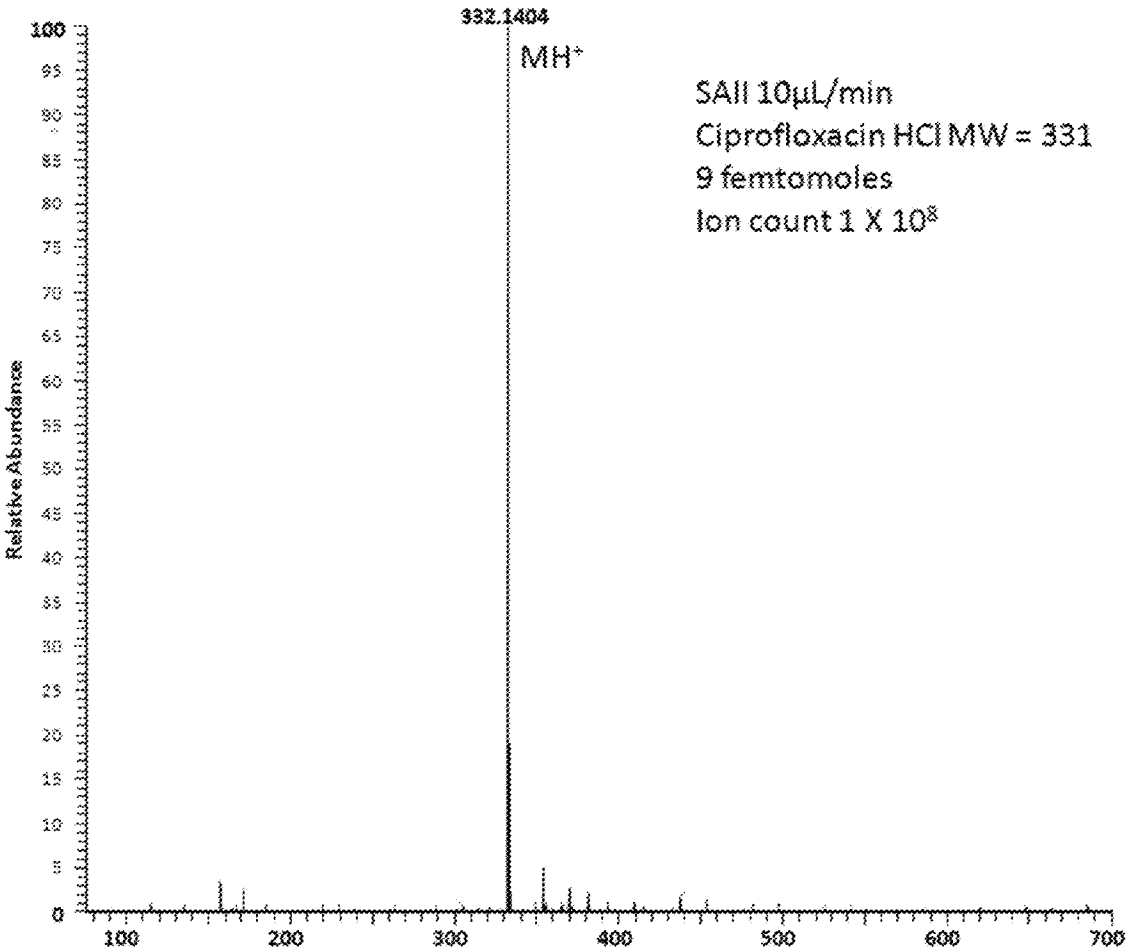
FIG. 26 illustrates the spectrum of nine femtomoles of ciprofloxacin in water acquired using solvent assisted inlet ionization.

FIG. 26 illustrates the spectrum of nine femtomole of ciprofloxacin acquired using solvent assisted inlet ionization in accordance with the setup illustrated in FIG. 6. Introducing ciprofloxacin into a heated transfer tube 102 in accordance with the SAII method described above results in a high ion count and signal-to-noise ratio.

Figure 27:
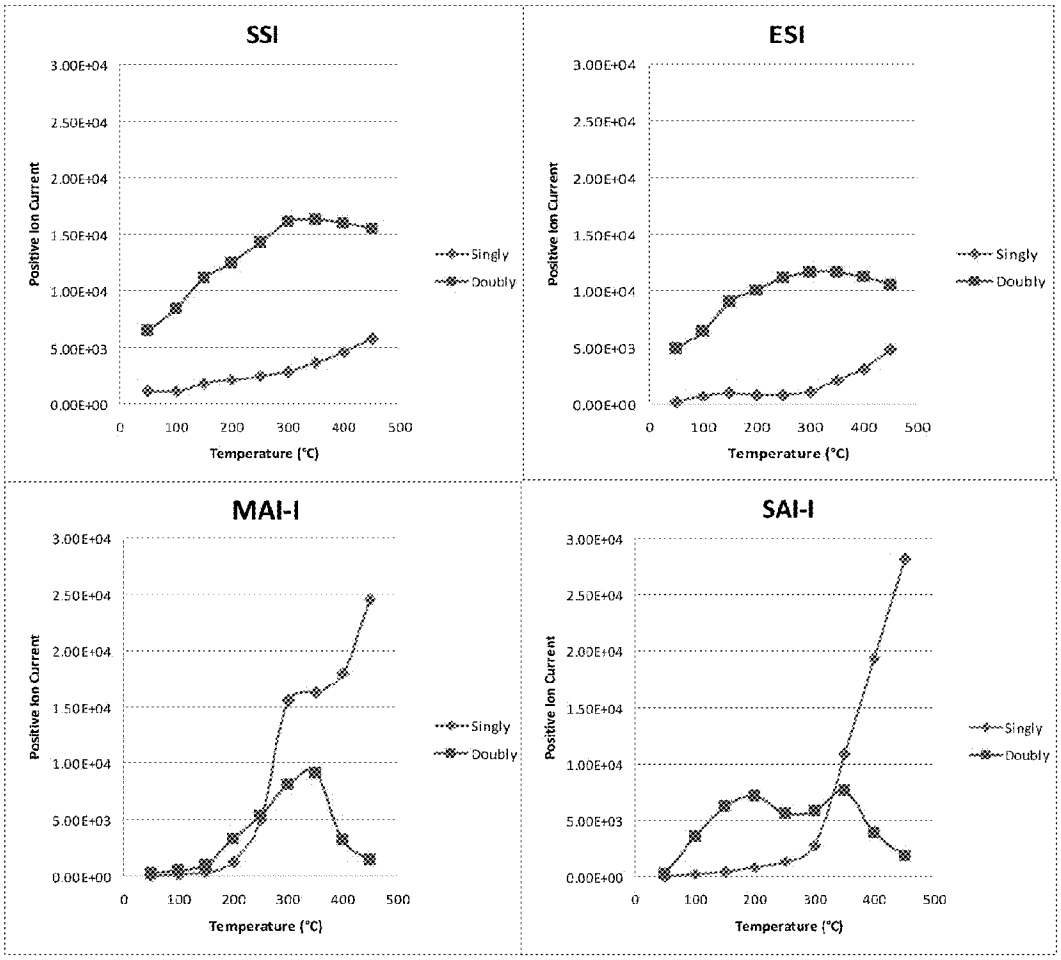
FIG. 27 includes a plurality of plots illustrating ion current versus inlet tube temperature for ions introduced using sonic spray ionization ("SSI"), electrospray ionization ("ESI"), matrix assisted inlet ionization "MAII"), and solvent assisted inlet ionization ("SAII")

FIG. 27 includes a plurality of plots illustrating ion current versus transfer capillary temperature for ions introduced to transfer tube 102 using SSI, ESI, MAII, and SAII. As shown in FIG. 27, MAII and SAII demonstrate significant increases in ion current of singly charged ions (low mass ions) as the temperature of the transfer capillary is heated, with MAII demonstrating a noticeable increase of ion current at approximately 200° C. and SAII demonstrating a noticeable increase in ion current at approximately 300° C. The SAII and MAII plots are similar, but significantly different from the SSI and ESI plots. MAII and SAII both produce ions within capillary 102 while the SSI and ESI methods produce ions in region 10.

ANALYSIS

The temperature requirement for the transfer tube 102 is somewhat dependent on the matrix or solvent and to some extent the analyte. Numerous matrixes have been tested experimentally, and although there may be an optimum temperature for each matrix and analyte, the peak of the optimum temperature is somewhat broad so fine tuning is not required. For example, using the matrix 2,5-dihydroxyacetophenone multiply charged ions of insulin were observed from <150° C. to >400° C.), but with a broad maximum between about 250° C. and 350° C. The maximum is only moderately compound dependant so that a single temperature can be used to ionize a wide range of compound types. Below 150° C., little ion current from insulin is observed, but at the highest temperatures, significant ion current is observed for insulin although some background ions become more abundant. Using the same matrix with the peptide substance P, doubly charged ions were observed with a capillary temperature of only 40° C. with comparatively lower but extended abundance than those observed with higher inlet temperatures.

The matrix 2,5-dihydroxybenzoic acid (2,5-DHB) has been found to produce little ion current below 200° C. Although most matrix materials tested to date produce positively charged ions, negative ions of, for example, ubiquitin are observed with 2,5-dihydroxyacetophenone and with anthranilic acid. Higher temperatures may be used to generate negative ions compared to the temperatures for generating positive ions, and higher mass compounds may ionize at higher temperatures than lower mass compounds.

The actual temperature required for production of ions from any matrix is also dependant on the transfer tube 102 length and diameter and to some extent the material of construction. Even a skimmer device having a transfer length of a fraction of a millimeter can act as an ionization region.

As described above, multiply charged ions may be produced by the arrangement illustrated in FIG. 1 by touching or otherwise introducing the matrix/analyte sample to the heated face of transfer capillary 102. Alternatively, a heated surface near the entrance 104 of transfer tube 102 produces ions if the material ejected from the hot surface as particles or droplets enters the heated transfer capillary 102. Any means of producing particles of matrix/analyte that enters the heated transfer capillary 102 that links the higher pressure region 10 to the vacuum region 30 will produce ions if the proper matrix or solvent and heat are used. Thus, laser ablation of a matrix as with LSI is one approach for producing particles or droplets of matrix/analyte that enter the transfer capillary by the momentum imparted by the explosive deposition of laser energy into the matrix. However, unlike LSI, the present method of ionizing materials described herein does not require, nor is it dependant on, an ultraviolet (UV) laser. Consequently, visible or infrared (IR) lasers may also be utilized and using a UV laser and UV adsorbing matrix materials is merely one means of moving matrix from a substrate to the transfer tube 102 for ionization. Moreover, unlike LSI, the disclosed system and method does not require that the substrate 116 be transparent to the UV laser for transmission geometry (where the laser beam travels through the substrate before striking the matrix), but as, for example, in LIAD the laser may dislodge matrix/analyte by the acoustic wave generated by the laser striking a thin opaque substrate.

Methods used to produce aerosols or ultrasonic methods can also be used to produce the matrix/analyte or analyte particles. The experiments described above demonstrated that an ultrasonic probe with the matrix/analyte mixture applied could be used to transfer matrix/analyte through the air gap between the probe surface and the transfer tube entrance 104 and produce ionization. Consequently, it has been demonstrated that a variety of delivery systems may be utilized for introducing the matrix/analyte sample directly into a heated transfer tube 102 including, but not limited to, using a melting point tube, a glass slide, or a spatula, or indirectly by using, for example, lasers, piezoelectric devices, and the generation of shockwaves. One skilled in the art will understand that other methods of producing particles or droplets from a surface can also be employed.

There are a number of advantages to the currently described ionization method. For example, unlike being limited to matrix materials that adsorb at a particular wavelength as in matrix assisted laser desorption/ionization MALDI, the disclosed system and method are not so limited and may utilize matrixes such as 2,5-DHB and 2,5-DHAP as well as a wide array of compounds including, but not limited to, dihydroxybenzoic acid and dihydroxyacetophenone isomers such as the 2,6-isomer. Other matrices used with MALDI as well as matrices in which an amine functionality replaces the hydroxyl group are useful matrices in the disclosed system and method. Some of the amine based matrices, such as anthranilic acid, allow negative multiply charged ions to be observed in low abundance.

Additionally, the disclosed system and method for producing multiply charged ions do not require a voltage, a gas flow (except the flow through transfer tube 102 resulting from the pressure differential between the inlet 104 and outlet 106), or a laser. Therefore, methods as simple as placing the sample on a melting point tube and touching a heated surface on or near the transfer inlet to the mass spectrometer or ion mobility analyzer are sufficient to produce highly charged ions of proteins, for example. The analyte can be introduced into the transfer capillary 102 in solution, such as water, organic solvent, water with organic solvent, weak acid, weak base, or salt modifiers. Pure analyte can be introduced into the transfer capillary as a solid, liquid or vapor to effect ionization. Pure water or water with modifiers listed above can be added to the transfer capillary to aid ionization of compounds vaporized in or into the heated transfer capillary. Any method to transfer matrix/analyte sample 114 into the transfer tube 102 is suitable to produce ions. Because particles can be produced by laser ablation or LIAD, methods that use focused lasers, high spatial resolution imaging is possible.

Another advantage of the disclosed system and method is that it does not require an ion source enclosure, which reduces the cost and complexity of the mass spectrometer as the entrance 104 to the transfer tube 102 can be unobstructed allowing objects to be placed near the ionization region for ionization of compounds on the surfaces. Alternatively, the transfer capillary 102 can be extended to allow remote sampling. This is a very low-cost ionization method as ionization may be produced using a heated transfer tube 102 and a means of introducing the sample in matrix to the entrance end 104 of the transfer capillary 102.

The experimental results set forth in FIGS. 22-24 demonstrate that an analyte sample may be introduced without the presence of a matrix. Additionally, the results in FIG. 21 demonstrate that introducing the analyte, with or without a matrix, to the transfer capillary in the presence of gases such as nitrogen, argon, and helium may increase the ionization thereby increasing the sensitivity of the system.

FIG. 24 demonstrates that the ionization increases with an increase in temperature of the transfer capillary to a certain point and the ionization decreases as the temperature increases after that point. Consequently, the temperature of the transfer capillary may be optimized for different analytes.

FIG. 25A illustrates the ion abundance of the +4 (m/z 1434) and +5 (m/z 1147) charge states of insulin in 1:1 acetonitrile:water consuming 280 attomoles using ESI. An improved insulin mass spectrum is obtained for the same amount of sample consumed in water using the SAII method described above.

FIG. 26 illustrates the high ion abundance and signal-to-noise achieved for only nine femtomoles of the drug ciprofloxacin consumed using the SAII method at a solvent flow rate of 10 $\mu L\ min^{-1}$.

FIG. 27 illustrates ion abundance versus temperature for singly and doubly charged ions of bradykinin using the ionization methods SSI, ESI, MAII, and SAII. As shown in FIG. 27, the inlet ionization methods MAII and SAII produce a similar profile but different results compared to ESI and SSI. For example, the plots of FIG. 27 demonstrate a large dependence on the inlet temperature for MAII and SAII and a small dependence for SSI and ESI—methods in which ionization occurs before the ion transfer tube entrance.

Figure 28:
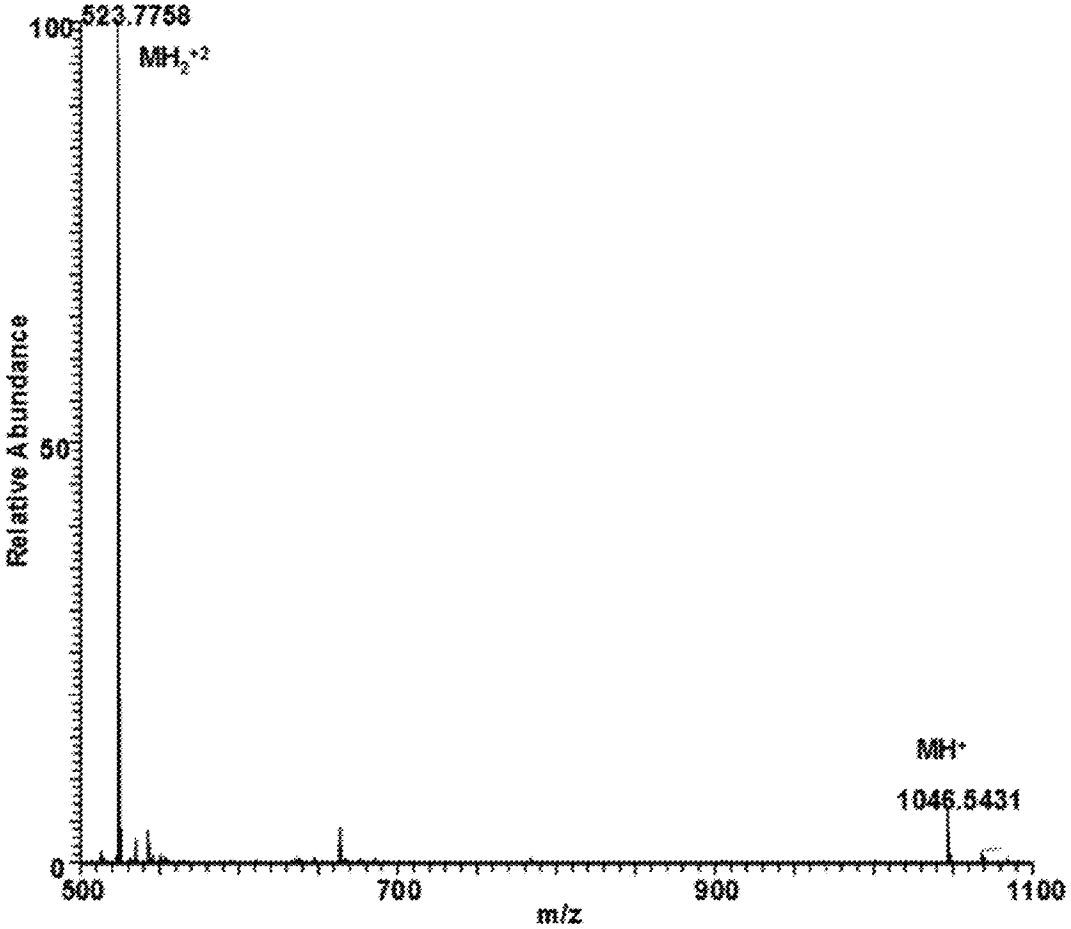
FIG. 28 shows the mass spectrum obtained for angiotensin II using the ionization configuration shown in FIG. 6.

FIG. 28 illustrates the mass spectrum obtained for angiotensin 1 using SAII with a transfer capillary temperature of 325° C. The doubly charged ions are approximately ten times more abundant than the singly charged ions.

Figure 29:
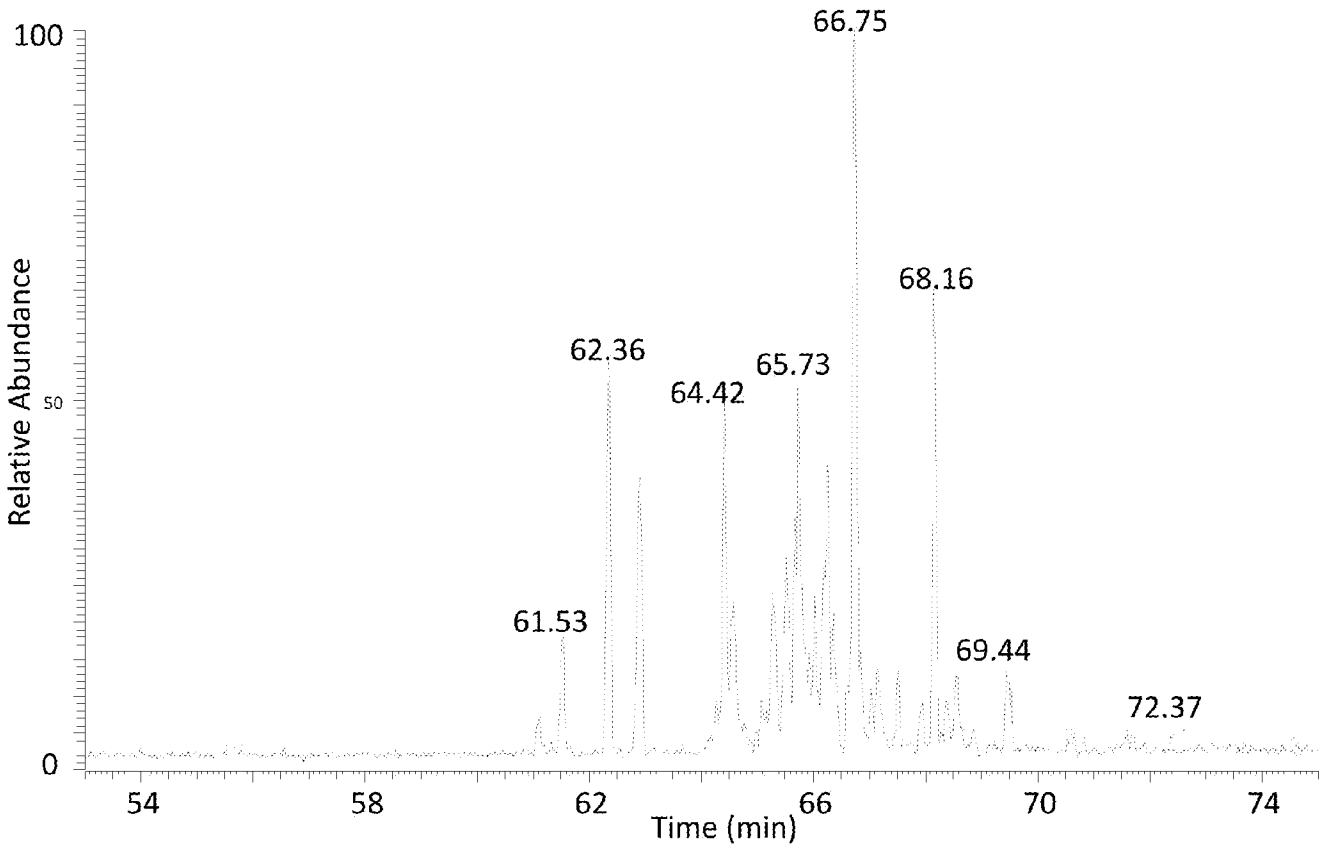
FIG. 29 illustrates a graph of elution volume versus ion abundance of bovine serum albumin tryptic digest eluting from a liquid chromatograph column.

FIG. 29 is a graph of elution volume shown as time vs. ion abundance for injection of 10 femtomoles of a BSA tryptic digest onto a C18 100 μm×100 mm LC column and using nanoSAII at a flow rate of 800 nanoliters per minute of mobile phase. The graph demonstrates that nanoSAII provides excellent chromatographic resolution and high sensitivity.

The inlet ionization concept that ionization occurring within the heated inlet 102 provides a very sensitivity mass spectrometric method for analytes can be extended to nanoESI and nanoSSl occurring within a transfer tube 102. The combination of inlet ionization that is voltage assisted, as in nanoESI, occurring within a transfer tube 102 or assisted by gas nebulization, as with nanoSSl, provides analytical advantages such as higher ion abundances or lower background. These experiments confirm that nanoESI can be accomplished within the inlet capillary 102.

Although the systems and methods have been described in terms of exemplary embodiments, they are not limited thereto. Rather, the appended claims should be construed broadly, to include other variants and embodiments of the disclosed systems and methods, which may be made by those skilled in the art without departing from the scope and range of equivalents of the disclosed systems and method.

What is claimed is:

1. An ionizing system, comprising:

a channel having an inlet disposed in a first pressure region and an outlet disposed in a second pressure region, a pressure of the first pressure region being greater than a pressure of the second pressure region;

a heater coupled to the channel and configured to heat the channel; and a device for introducing at least one analyte molecule into the channel through which the at least one analyte molecule is ionized by the heat and pressure-differential applied in the channel to generate at least one analyte molecule ion.

2. The ionizing system of claim 1, wherein the channel is defined by a transfer tube that is coupled to the heater such that the transfer tube is heated by the heater.

3. The ionizing system of claim 1, wherein the channel is defined by the heater.

4. The ionizing system of claim 1, wherein a skimmer is disposed over the inlet of the channel and defines an opening that is in fluid communication with the channel.

5. The ionizing system of claim 1, wherein the device is a substrate on which the at least one analyte molecule is disposed.

6. The ionizing system of claim 5, wherein the substrate is disposed adjacent to the inlet of the channel and is configured to be contacted by one of a physical object or electromagnetic energy.

7. The ionizing system of claim 1, wherein the at least one analyte molecule is mixed with a matrix.

8. The ionizing system of claim 1, wherein the device includes:

a container in which a solution including the at least one analyte molecule is disposed;

a conduit having a first end disposed in the container such that the first end is in contact with the solution including the at least one analyte molecule and a second end disposed adjacent to or within the inlet of the channel.

9. The ionizing system of claim 8, further comprising an electrode disposed within the container and configured to apply a voltage to the solution including the at least one analyte molecule.

10. The ionizing system of claim 1, wherein the device includes:

a container in which a solution including the at least one analyte molecule is disposed;

a mixing tube having a first end and a second end, the first end of the mixing tube receiving a capillary having a first end disposed within the solution, the second end of the mixing tube having a transfer tube extending therefrom such that an end of the transfer tube is disposed adjacent to or within the channel; and a nebulizing tube configured to inject a nebulizing gas into the mixing tube.

11. The ionizing system of claim 10, wherein a flow rate of the solution including the at least one analyte molecule is on the order of nanoliters per minute.

12. The ionizing system of claim 1, wherein the channel is in fluid communication with one of a mass spectrometer or an ion mobility analyzer.

13. The ionizing system of claim 1, wherein a gas at the inlet of the channel includes at least one of helium, argon, and nitrogen.

14. An ionizing method, comprising:

creating a pressure differential across a channel having a first end disposed in a first pressure and a second disposed in a second pressure, the first pressure being greater than the second pressure;

heating the channel;

receiving at least one analyte molecule in the channel; and ionizing the at least one analyte molecule as the at least one analyte molecule moves through the channel, wherein the at least one analyte molecule is ionized by heat and the pressure-differential applied in the channel to generate at least one analyte molecule ion.

15. The ionizing method of claim 14, further comprising applying a voltage to the at least one analyte molecule when the at least one analyte molecule is disposed in a solution within a container.

16. The ionizing method of claim 15, wherein the analyte molecule is received within the channel from a conduit having a first end disposed in the container such that the first end is in contact with a solution including the analyte molecule and a second end is disposed adjacent to or within an inlet of the channel.

17. The ionizing method of claim 14, wherein the at least one analyte molecule is received within the channel from a conduit having a first end disposed in the container such that the first end is in contact with a solution including the at least one analyte molecule and a second end is disposed within a mixing tube having a first end disposed within or adjacent to an inlet of the channel.

18. The ionizing method of claim 17, further comprising:

receiving a nebulizing gas in the mixing tube; and receiving the nebulizing gas and the at least one analyte molecule in the channel from an end of a transfer tube that extends from the first end of the mixing tube.

19. The ionizing method of claim 14, further comprising receiving the at least one analyte molecule in an ionized form at a mass analyzer.

20. The ionizing method of claim 14, wherein the at least one analyte molecule is received in the channel in a gas phase.

21. The ionizing method of claim 14, wherein the at least one analyte molecule is mixed with one of a matrix or a solvent.

22. The ionizing method of claim 14, wherein a gas at the inlet of the channel includes at least one of helium, argon, and nitrogen.

23. The ionizing system of claim 1, further comprising an obstruction disposed along an axis defined by the channel.

24. The ionizing system of claim 23, wherein the obstruction is disposed adjacent to the outlet of the channel.

* * * * *